US007983599B2

(12) United States Patent
Pak et al.

(10) Patent No.: US 7,983,599 B2
(45) **Date of Patent: *Jul. 19, 2011**

(54) AUTOMATIC BELT TENSION APPARATUS OF IMAGE FORMING DEVICE AND METHOD THEREOF

(75) Inventors: Ki-Ju Pak, Yongin (KR); Hyo-jin Lee, Suwon (KR); Il-kwon Kang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 868 days.

This patent is subject to a terminal disclaimer.

(21) Appl. No.: 11/339,635

(22) Filed: Jan. 26, 2006

(65) Prior Publication Data

US 2006/0120757 A1 Jun. 8, 2006

(51) Int. Cl.
*G03G 15/00* (2006.01)

(52) U.S. Cl. ..... 399/165; 399/167

(58) Field of Classification Search ..... 399/165, 399/167

See application file for complete search history.

(56) References Cited

U.S. PATENT DOCUMENTS

| | | | | |
|---|---|---|---|---|
| 6,058,286 | A | 5/2000 | Park | |
| 6,067,436 | A | 5/2000 | Kohno et al. | |
| 6,161,522 | A | 12/2000 | Fuchita et al. | |
| 6,249,662 | B1 | 6/2001 | Lee | |
| 6,264,578 | B1 * | 7/2001 | Ayukawa | 474/135 |
| 6,445,895 | B2 | 9/2002 | Shirasawa et al. | |
| 6,711,367 | B2 | 3/2004 | Saito et al. | |
| 6,865,361 | B2 | 3/2005 | Abe et al. | |
| 6,871,036 | B2 | 3/2005 | Asuwa et al. | |
| 7,359,658 | B2 * | 4/2008 | Lee et al. | 399/165 |
| 2005/0063731 | A1 | 3/2005 | Fiore et al. | |

FOREIGN PATENT DOCUMENTS

| | | | |
|---|---|---|---|
| JP | 59083186 | A * | 5/1984 |
| JP | 03-230186 | | 10/1991 |
| JP | 04-051279 | | 2/1992 |
| JP | 05-201576 | | 8/1993 |
| JP | 06-348148 | | 12/1994 |
| JP | 2000-47528 | | 2/2000 |
| JP | 2000-172123 | | 6/2000 |
| JP | 2001-13799 | | 1/2001 |
| JP | 2001-022188 | | 1/2001 |
| JP | 2002-72700 | | 3/2002 |
| JP | 2002-148959 | | 5/2002 |
| KR | 20-179589 | | 5/2000 |

OTHER PUBLICATIONS

Machine Translation of JP 2001-022188.*
Japanese Office Action for Application No. 2004-099614; dated Oct. 3, 2006.
Japanese Office Action for Application No. 2004-099614; mailed Jun. 13, 2006.

* cited by examiner

*Primary Examiner* — David P Porta
*Assistant Examiner* — Bryan P Ready
(74) *Attorney, Agent, or Firm* — Staas & Halsey LLP

(57) ABSTRACT

An automatic belt tension apparatus of an image forming device having: a tension actuating part connected to the driving unit and operating by a driving force of a driving unit; a tension applying part to selectively apply a predetermined tension to a belt, installed with respect to the belt; and a tension releasing part to operate the tension applying part to not apply the predetermined tension to the belt, installed with respect to the tension applying part.

29 Claims, 12 Drawing Sheets

AUTOMATIC BELT TENSION APPARATUS OF IMAGE FORMING DEVICE AND METHOD THEREOF

CROSS-REFERENCE TO RELATED APPLICATIONS

This application claims the priority of Korean Patent Application No. 2003-44708, filed on Jul. 2, 2003, in the Korean Intellectual Property Office, and U.S. patent application Ser. No. 10/801,850, currently pending, the disclosures of which are incorporated herein by reference.

BACKGROUND OF THE INVENTION

1. Field of the Invention

The present invention relates to an image forming device such as a printer, a copier, and a Fax, and more particularly, to an automatic belt tension apparatus of an image forming device that can automatically apply a predetermined tension to a transfer belt or a photosensitive belt only when a belt unit such as a transfer unit or an intermediate transfer unit comprising the transfer belt, or a photosensitive body comprising the photosensitive belt, is operated, and a method thereof.

2. Description of the Related Art

In general, a typical electrophotograph color image forming device is provided with: a plurality of image forming units; a plurality of photosensitive bodies, each on which a toner image of color different from one another is formed by the corresponding respective image forming units; a transfer unit having a transfer belt or a transfer roller sequentially transferring the toner images formed on the photosensitive bodies to a recording medium such as a sheet of paper; and a fusing unit fixing the toner images transferred onto the recording medium with a heat and a pressure.

Another color image forming device comprises an intermediate transfer unit having an intermediate transfer element such as a transfer belt disposed between the photosensitive bodies and the transfer unit. In this case, the toner images formed on the photosensitive bodies are not directly transferred to the recording medium, but first formed as a first transfer image on the intermediate transfer element and then transferred to the recording medium.

These color image forming devices generally use a plurality of photosensitive drums, each forming a toner image of color different from one another thereon, as the plurality of photosensitive bodies. But some image forming devices, for example, a wet type image forming device, use one photosensitive belt instead of the plurality of photosensitive drums. In this case, toner images of colors different from one another are formed on the photosensitive belt by a plurality of developing parts forming the image forming units, transferred onto the recording medium via the transfer roller of the transfer unit, and then fixed on the recording medium by the fusing unit.

Also, in these color image forming devices, a tension apparatus is used to maintain the transfer belt installed in the transfer unit or the intermediate transfer unit, or the photosensitive belt used instead of the photosensitive drums in a tensioned state of coming in contact with the photosensitive drums or the transfer roller of the transfer unit in a predetermined pressure during the transfer operation or the image forming operation.

FIGS. 1 and 2 show an intermediate transfer unit 10 of a general color image forming device using a transfer belt as an intermediate transfer element.

The intermediate transfer unit 10 is provided with: an intermediate transfer belt 9 changing toner images formed on photosensitive bodies 11Y, 11M, 11C, 11K by image forming units (not shown) into a first transfer image; first transfer rollers 15Y, 15M, 15C, 15K pressing the photosensitive bodies 11Y, 11M, 11C, 11K with a predetermined pressure with the intermediate transfer belt 9 interposed therebetween; and a transfer belt tension apparatus 20 applying a predetermined tension to the intermediate transfer belt 9 to allow the intermediate transfer belt 9 and the photosensitive bodies 11Y, 11M, 11C, 11K to be in contact with each other with a predetermined pressure.

The intermediate transfer belt 9 is rotatably installed on a driving roller 7 supported on a frame 1 by: a driving shaft 3 having a driving gear 5; supporting and backup rollers 13 and 15, which are respectively supported on the frame 1 by corresponding shafts 13*a* and 15*a*; and a second transfer backup roller 8 supported on the frame 1 by corresponding shaft 8*a*.

At a lower part of the second transfer backup roller 8, a transfer roller 17 of a second transfer unit (not shown), which transfers the first transfer image formed on the intermediate transfer belt 9 onto a sheet of paper, comes in contact with the intermediate transfer belt 9 with a predetermined pressure.

The transfer belt tension apparatus 20 is provided with a swing shaft 25 having both ends supported at the frame 1, a tension roller 21 coming in contact with an inner surface of the intermediate transfer belt 9, a swing arm 23 connecting the tension roller 21 to the swing shaft 25, and a tension spring 27 imparting an elastic rotating force to the swing shaft 25 in a direction of enabling the tension roller 21, connected to the swing shaft 25 through the swing arm 23, to be in contact with the inner surface of the intermediate transfer belt 9.

The tension spring 27 has one end 27*a* supported in a first fixing groove 24*a* positioned at the swing arm 23 and an other end 27*b* supported in a second fixing groove 29*a* of a spring boss 29 positioned at the frame 1.

Accordingly, the tension spring 27 urges the tension roller 21 to always push the intermediate transfer belt 9 in a direction of arrow A of FIG. 1, and thereby the intermediate transfer belt 9 is maintained in a tensioned state to contact the photosensitive bodies 11Y, 11M, 11C, 11K with the predetermined pressure.

But, the conventional intermediate transfer unit 10 constructed as above when used for a long period of time, may present a problem. Since the tension roller 21 is continuously applying the tension to the intermediate transfer belt 9, the length of the intermediate transfer belt 9 grows longer, thereby inducing speed deviation during the transfer operation.

Also, with the conventional intermediate transfer unit 10, when left as it is without being used for a long period of time, the intermediate transfer belt 9 may generate traces at portions thereof coming in contact with the driving roller 7, the supporting and backup rollers 13 and 15, and the second transfer backup roller 8, thereby degrading a quality of the image formed during the transfer operation.

These problems may occur in the transfer unit using the transfer belt and the photosensitive body composed of the photosensitive belt, as well as the conventional intermediate transfer unit 10.

SUMMARY OF THE INVENTION

Additional aspects and/or advantages of the invention will be set forth in part in the description which follows, and in part, will be obvious from the description, or may be learned by practice of the invention.

It is, therefore, an aspect of the present invention to provide an automatic belt tension apparatus of an image forming device and method thereof, which can apply a predetermined tension to a photosensitive belt or a transfer belt only when a belt unit such as a transfer unit or an intermediate transfer unit comprising the transfer belt, or a photosensitive body composed of the photosensitive belt is operated, so that even though the image forming device is used for a long period of time or left as it is for a long period of time, the photosensitive belt or the transfer belt can be prevented form being expanded or generating traces at portions thereof coming in contact with driving and supporting rollers, thereby extending life of the transfer belt or the photosensitive belt and the image forming device using the same and at the same time, maintaining a quality in image in a regular level for a long period of time.

To achieve the above aspect and/or other features of the present invention, there is provided an automatic belt tension apparatus for use in an image forming device with at least one belt, and a driving unit supporting the belt and driving the belt to rotate, the automatic belt tension apparatus having: a tension actuating part connected to the driving unit and operating by a driving force of the driving unit; a tension applying part to selectively apply a predetermined tension to the belt, installed with respect to the belt; and a tension releasing part to operate the tension applying part to not apply the predetermined tension to the belt, installed with respect to the tension applying part.

According to one aspect, the tension applying part has: a swing shaft having both ends supported at a frame; a tension roller selectively coming in contact with an inner surface of the belt; and a swing arm fixed on the swing shaft and rotatably supporting the tension roller.

According to one aspect, the tension releasing part has an elastic member exerting an elastic rotating force on the swing arm, to enable the tension roller to swing in an opposite direction to a direction of contacting with the inner surface of the transfer belt, the elastic member being installed with respect to the frame and the swing arm.

According to one aspect, the elastic member has a tension spring installed with respect to the swing arm, the tension spring having respective ends supported at the frame and the swing arm.

According to one aspect, the tension releasing part has a release-enabling member removing a gear force from the driving unit to swing the swing arm in a direction of separating the tension roller from the inner surface of the belt by the elastic member when the driving unit is stopped from driving.

According to one aspect, the release-enabling member has a solenoid actuating the swing arm to move in the direction of separating the tension roller from the inner surface of the belt when the driving part is stopped from driving.

According to one aspect, the release-enabling member has one of a one way power transmitting part, or a swing gear part, disposed on a power transmitting path to transmit a driving force from the driving unit to the tension applying part, and to not transmit a rotating force of the swing arm to the driving unit when the driving unit is stopped from driving and thereby the elastic force of the elastic member acts on the swing arm in the direction of separating the tension roller from the inner surface of the belt.

According to one aspect, the release-enabling member has a motor power cut part to cut a power of a driving motor driving the driving unit when the driving unit is stopped from driving.

According to one aspect, the tension actuating part has: a tension gear installed on the driving unit; and a power transmitting gear train having a plurality of power transmitting gears connected with the tension gear, to transmit a driving force of the tension gear to the swing shaft.

According to one aspect, the tension applying part additionally has a tension clutch installed on the swing shaft and transmitting a driving force transmitted to the power transmitting gear train from the tension gear, to the swing shaft only when the driving force is in a range of a predetermined load torque.

According to one aspect, the tension clutch has: a clutch gear, rotatably installed on the swing shaft to engage with the power transmitting gear train, and having a first clutch boss extended in an axial direction; a bushing having a second clutch boss fixed on the swing shaft; and a clutch spring coiled on outer circumferential surfaces of the first clutch boss of the clutch gear and the second clutch boss of the bushing, and when the driving force is transmitted from the power transmitting gear train to the clutch gear, transmitting the driving force to the bushing fixed on the swing shaft only when a driving load of the clutch gear is in the range of the predetermined load torque.

According to one aspect, the range of the predetermined load torque of the clutch gear is set such that the tension roller, fixed on the swing shaft through the swing arm, applies the predetermined tension to the belt against a bias of an elastic member of the tension releasing part.

To achieve the above and/other aspects of the present invention, there is provided a method for automatically applying a belt tension of an image forming device including at least one belt and a driving unit supporting and driving the belt to rotate, the method having the operations: driving the driving unit; selectively transmitting a driving force from the driving unit to a tension applying part; applying a tension to the belt by using the driving force transmitted from the tension applying part; stopping the driving unit from driving; and releasing the tension applied to the belt.

According to one aspect, the operation of selectively transmitting the driving force from the driving unit to the tension applying part has: applying the driving force to the tension applying part when the driving force transmitted from the driving unit is in a predetermined range.

According to one aspect, the operation of applying the tension to the belt has: rotating a swing arm in a first direction against a bias of an elastic member by the driving force transmitted from the tension applying part; and bringing the tension roller connected to the swing arm into contact with the belt.

According to one aspect, the operation of releasing the tension applied to the belt has: removing a gear force from the driving unit; rotating the swing arm in a second direction, opposite to the first direction by the bias of the elastic member; and separating the tension roller from the belt. And according to one aspect, the operation of removing the gear force from the driving unit has one of: actuating the swing arm to forcedly rotate in the second direction; actuating a rotating force to idle the rotating force transmitted from the swing arm to the driving unit by the bias of the elastic member; or cutting a power of a driving motor driving the driving unit.

Additional aspects and/or advantages of the invention will be set forth in part in the description which follows, and in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
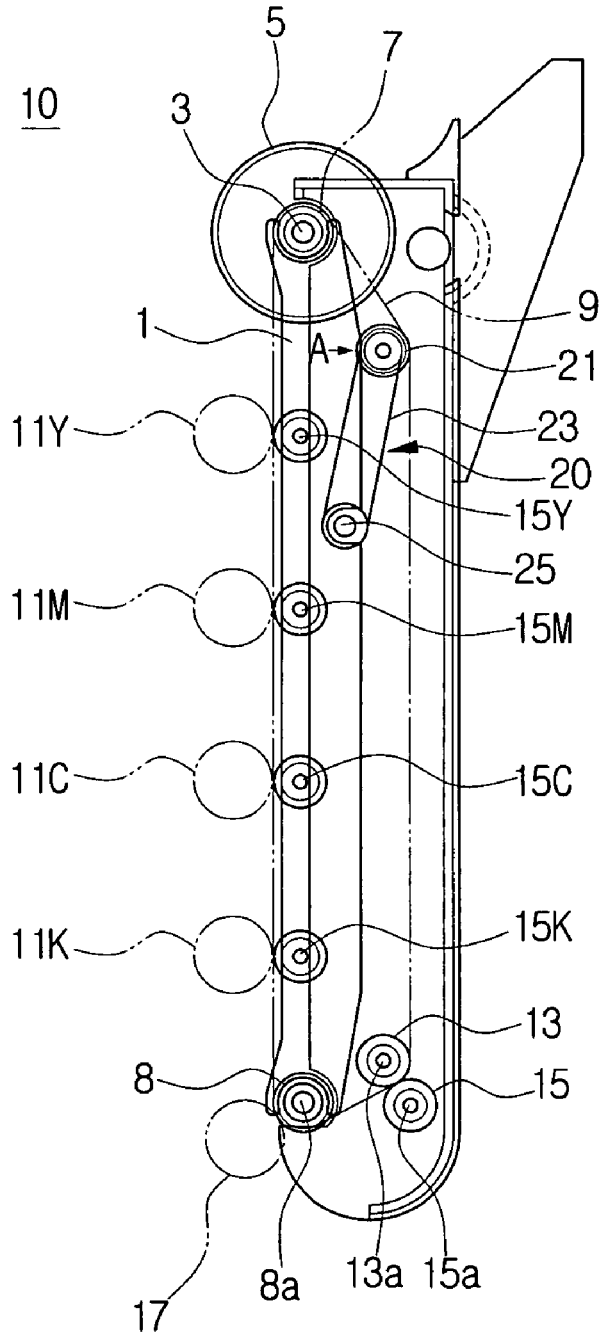
FIG. 1 (PRIOR ART)
FIG. 1 is a schematic side elevation view of a general intermediate transfer unit of an image forming device.
Figure 2:
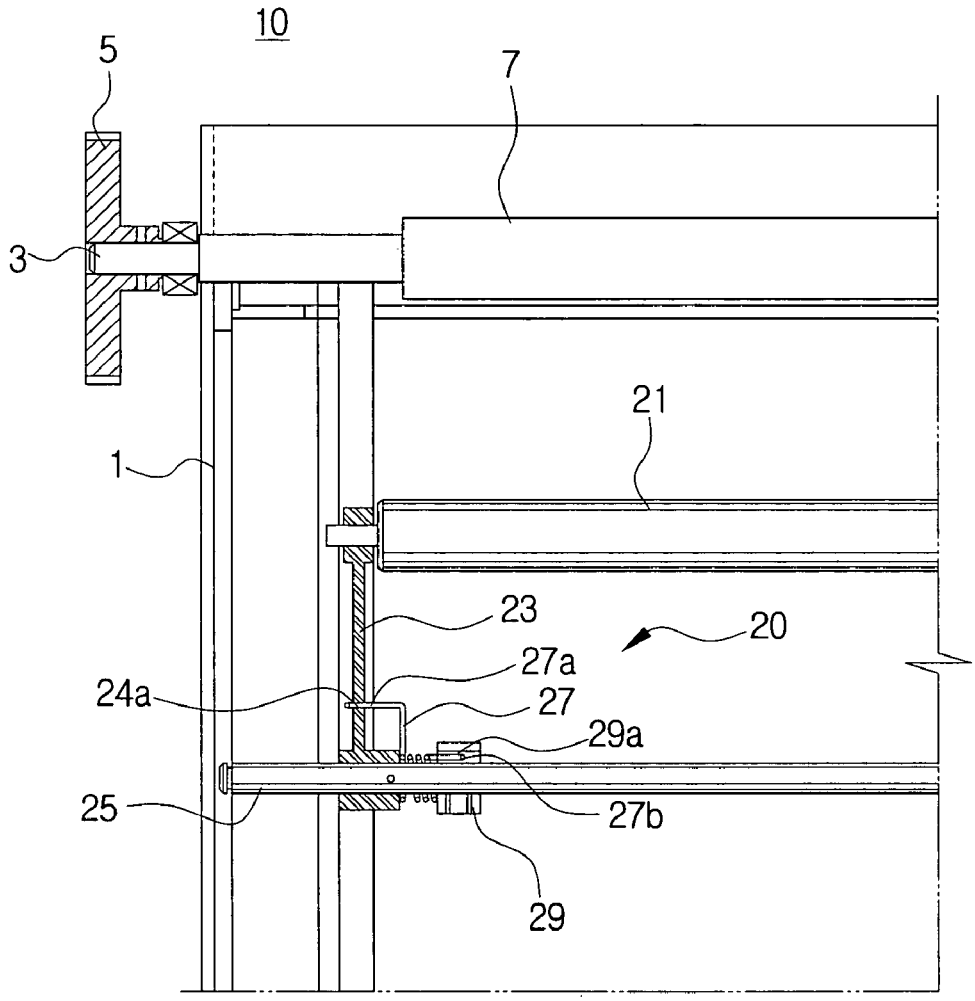
FIG. 2 (PRIOR ART)
FIG. 2 is a partial front elevation view of an transfer belt tension apparatus of the intermediate transfer unit shown in FIG. 1.

Reference will now be made in detail to embodiments of the present invention, examples of which are illustrated in the accompanying drawings, wherein like reference numerals refer to the like elements throughout. The embodiments described below explain the present invention by referring to the figures.

Embodiment 1

Figure 3:
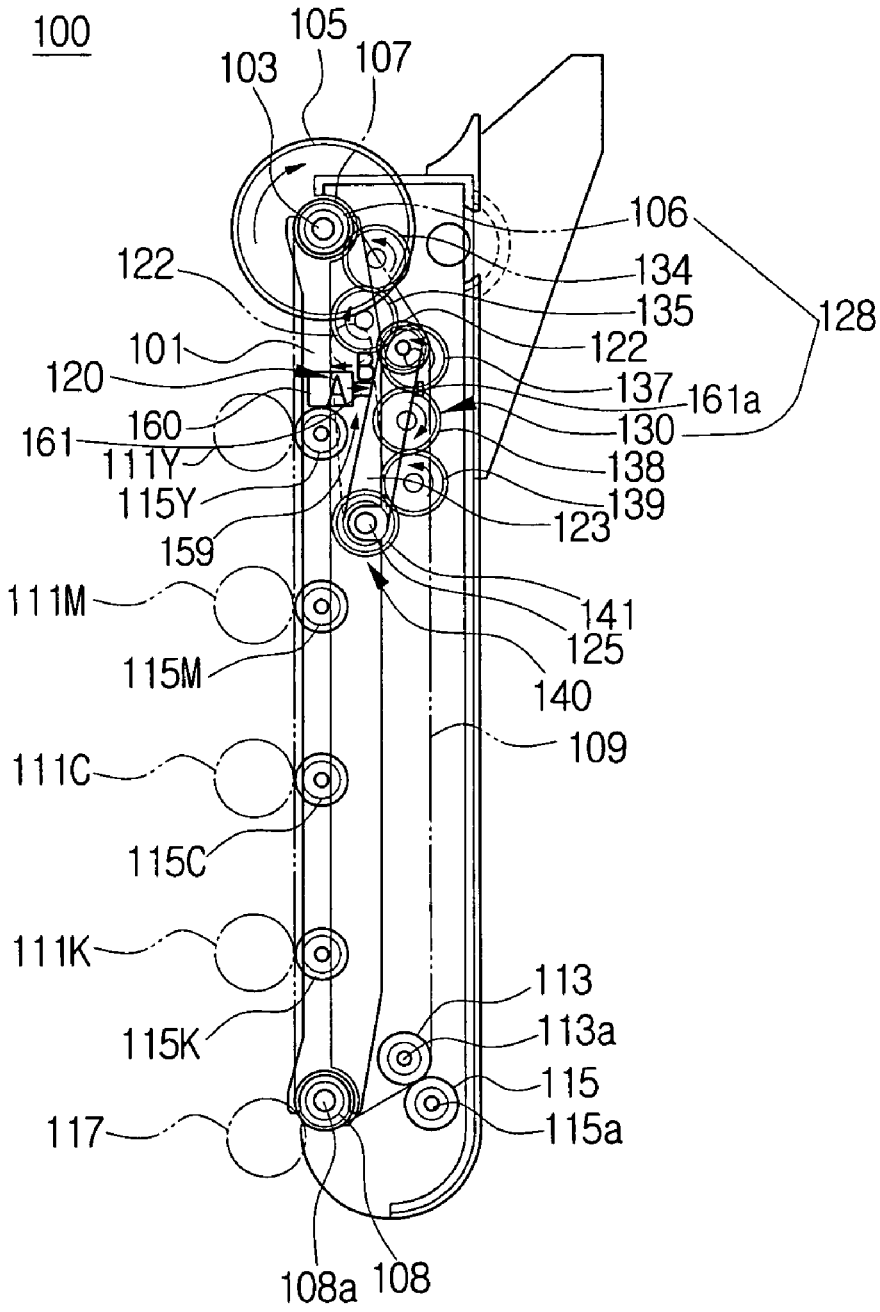
FIG. 3 is a schematic side elevation view of an intermediate transfer unit of an image forming device to which an automatic belt tension apparatus is applied according to a first embodiment of the present invention.
Figure 4:
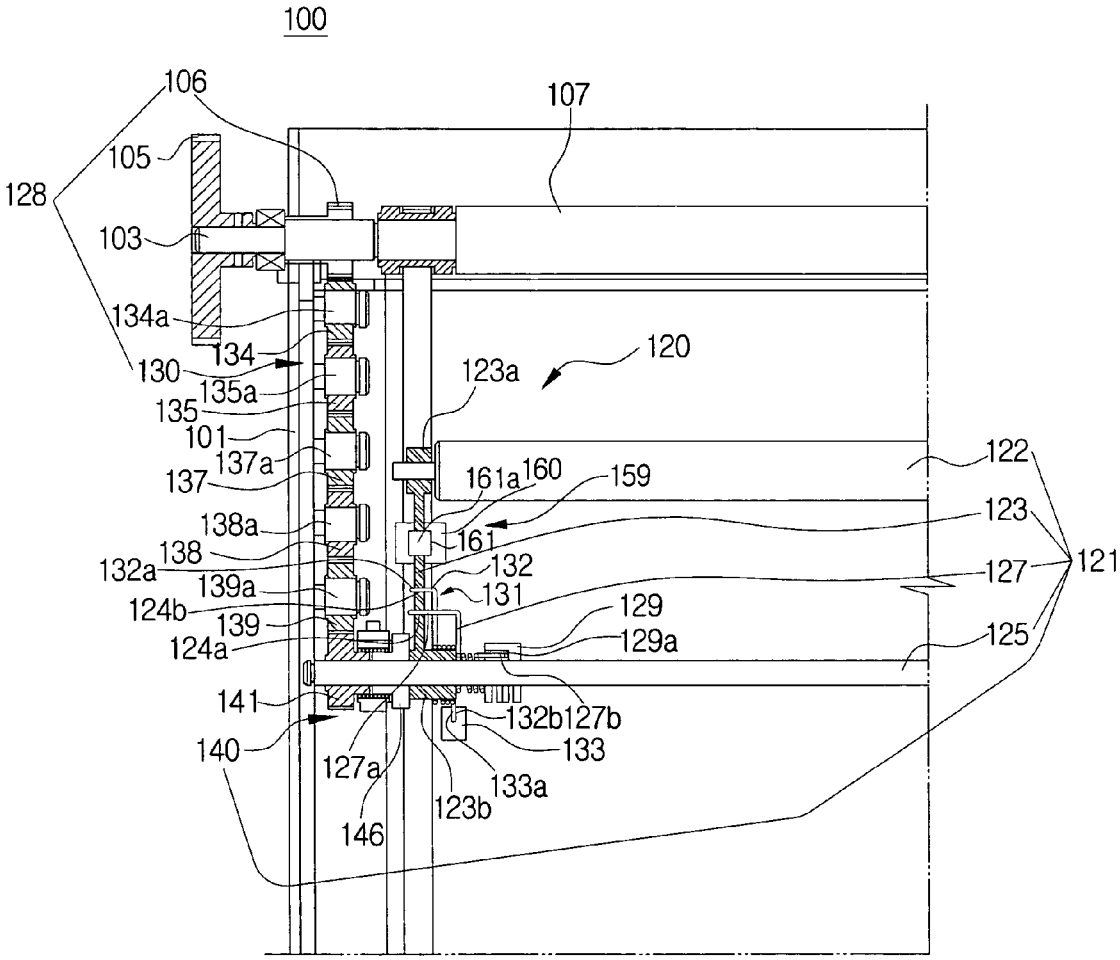
FIG. 4 is a partial front elevation view of the automatic belt tension apparatus of FIG. 3.

Referring to FIGS. 3 and 4, there is illustrated an intermediate transfer unit 100 of an electrophotograph color printer, to which an automatic belt tension apparatus 120 is applied, according to a first embodiment of the present invention.

The intermediate transfer unit 100 comprises: an intermediate transfer belt 109 changing toner images formed on four drum-shaped photosensitive bodies 111Y, 111M, 111C, 111K, each of which is respectively disposed in four image forming units (not shown) for forming toner images of yellow, magenta, cyan and black colors, into a first transfer image; four first transfer rollers 115Y, 115M, 115C, 115K pressing the photosensitive bodies 111Y, 111M, 111C, 111K with a first predetermined pressure with the intermediate transfer belt 109 interposed therebetween; and the automatic belt tension apparatus 120 applying a predetermined tension to the intermediate transfer belt 109, to allow the intermediate transfer belt 109 and the photosensitive bodies 111Y, 111M, 111C, 111K be in contact with each other with a second predetermined pressure.

The intermediate transfer belt 109 is wound to be rotatable on: a driving roller 107 supported on a frame 101 by a driving shaft 103, supporting and backup rollers 113 and 115 supported on the frame 101 by corresponding shafts 113*a* and 115*a*, and a second transfer backup roller 108 supported on the frame 101 by corresponding shaft 108*a*.

The driving shaft 103 is provided with a driving gear 105 connected with a driving motor (not shown) through a gear train (not shown), and a tension gear 106 driving a power transmitting gear train 130 of a tension actuating part 128, positioned between the driving gear 105 and the driving roller 107. The tension gear 106 constitutes a portion of the tension actuating part 128.

At a lower part of the second transfer backup roller 108, a transfer roller 117 of a second transfer unit (not shown), which transfers the first transfer image formed on the intermediate transfer belt 109 onto a sheet of paper, is disposed to come in contact with the intermediate transfer belt 109.

The automatic belt tension apparatus 120 comprises: a tension applying part 121 (FIG. 4) installed with respect to the intermediate transfer belt 109 and applying the predetermined tension to the intermediate transfer belt 109 to allow the transfer belt 109 to be in contact with the photosensitive bodies 111Y, 111M, 111C, 111K with the second predetermined pressure; a tension releasing part 131 installed with respect to the tension applying part 121 and operating the tension applying part 121 to not apply the predetermined tension to the intermediate transfer belt 109; and the tension actuating part 128 connected with the driving shaft 103 so as to be operated by the driving shaft 103 supporting the driving roller 107 to drive the intermediate transfer belt 109, and actuating the tension applying part 121 to apply the predetermined tension to the intermediate transfer belt 109 against the tension releasing part 131 when the driving shaft 103 is rotated.

The tension applying part 121 is provided with a swing shaft 125 having both ends supported at the frame 101, a tension roller 122 coming in contact with an inner surface of the intermediate transfer belt 109, and a swing arm 123 having a first boss 123*a* rotatably supporting the tension roller 122 and a second boss 123*b* fixed on the swing shaft 125.

The tension applying part 121 further comprises a tension clutch 140 so that the driving force can be transmitted to the swing shaft 125 of the tension applying part 121 only when the driving force is in the range of a predetermined load torque, which is transmitted from the tension gear 106 of the tension actuating part 128 to a power transmitting gear train 130.

Figure 5:
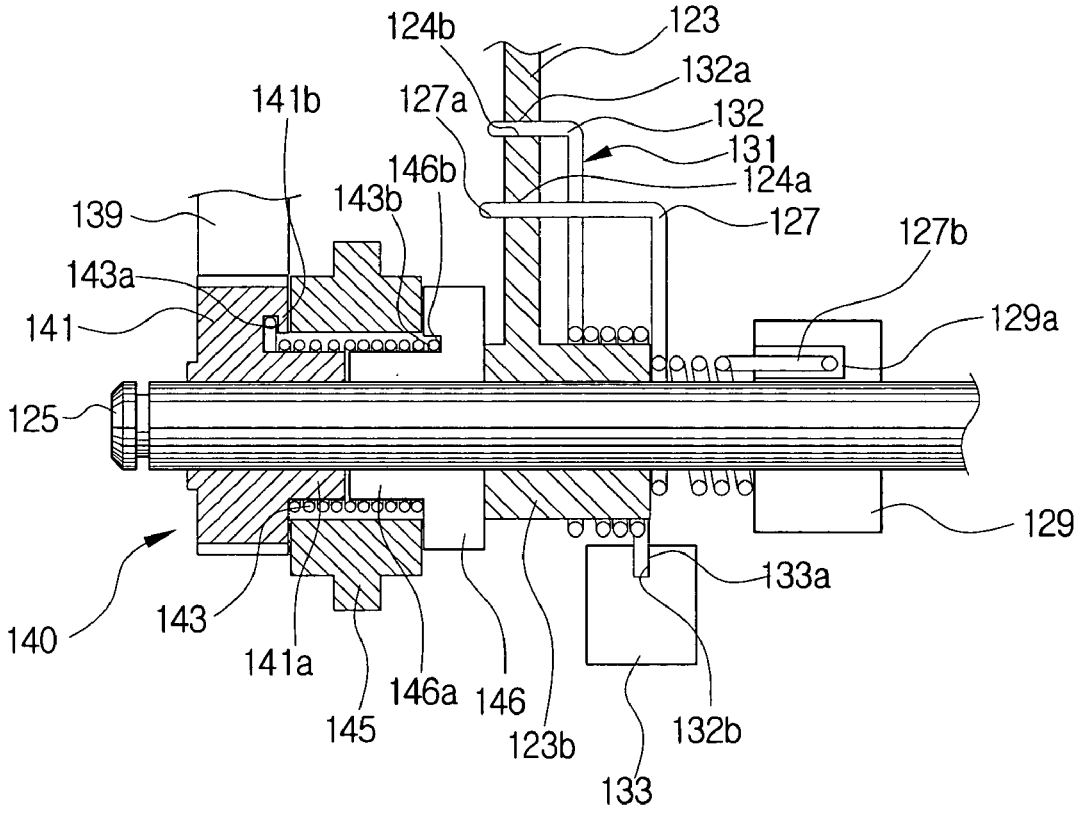
FIG. 5 is a cross-sectional view of a spring clutch of the automatic belt tension apparatus of FIG. 4.

As shown in FIG. 5, the tension clutch 140 comprises a clutch gear 141 rotatably engaged with the swing shaft 125 to be meshed with the fifth power transmitting gear 139 of the power transmitting gear train 130 and having a first clutch boss 141*a* extended in a shaft direction, a bushing 146 having a second clutch boss 146*a* fixed on the swing shaft 125, and an elastic clutch member (or clutch spring) 143, coiled on outer circumferential surfaces of the first clutch boss 141*a* of the clutch gear 141 and the second clutch boss 146*a* of the bushing 146, to generate a sliding friction force (Fμ), so that the driving force of the tension gear 106 is transmitted from the fifth power transmitting gear 139 of the power transmitting gear train 130 to the clutch gear 141 only when the driving force, i.e., the rotating force of the clutch gear 141, is in the range of a predetermined load torque.

The clutch spring 143 is wound in a rotating direction of the clutch gear 141, such as in a clockwise direction, so that the rotating force of the clutch gear 141 can be transmitted to the bushing 146 when the clutch gear 141 is rotated by the fifth power transmitting gear 139 of the power transmitting gear train 130.

Around the clutch spring 143, a clutch ring 145 is disposed to tightly close up the clutch spring 143. The clutch ring 145 is movably supported over the bushing 146.

Also, the clutch spring 143 has a first end 143*a* slipably supported by a first support 141*b*, and a second end 143*b* fixedly supported by a second support 146*b*, comprising a groove formed in the vicinity of an inner edge of an outer surface of the bushing 146. According to one aspect, the first support 141*b* comprises a circular-shaped concavo-convex groove. At another aspect, the first support 141*b* comprises a plurality of spaced-apart grooves circumferentially positioned adjacent to an inner edge of an outer surface of the first clutch boss 141*a* of the clutch gear 141.

Since the first end 143*a* of the clutch spring 143 is slipably supported by the first support 141*b* of the clutch gear 141, when the rotating force of the clutch gear 141 exceeds the range of the predetermined load torque, the first end 143*a* of the clutch spring 143 slips over the first support 141*b*, and thereby the first clutch boss 141*a* comes in slide contact with the clutch spring 143, so that the clutch gear 141 idles and does not transmit the rotating force thereof to the bushing 146.

Two embodiments of the first support 141*b* are described above, namely, the circular-shaped concavo-convex groove and the plurality of spaced-apart grooves. It should be noted, however, that the first support 141*b* may be any other form capable of slipably supporting the first end 143*a* of the clutch spring 143, for example, a projection or a plurality of circumferentially spaced-apart projections formed on an inner edge of the outer surface of the first clutch boss 141*a* of the clutch gear 141.

Also, only the first end 143*a* of the clutch spring 143 is described as slipably supported by the first support 141*b*, but according to one aspect, both the first and second ends 143*a* and 143*b* of the clutch spring 143 are slipably supported by the first and the second supports 141*b* and 146*b*. According to another aspect, only the second end 143*b* of the clutch spring 143 is slidably supported by the second support 146*b*.

To say nothing of the construction, according to one aspect, the range of the predetermined load torque of the clutch gear 141 of supporting the first and/or second ends 143*a*, 143*b* of the clutch spring 143 without slip is such that the tension roller 122, fixed on the swing shaft 125 through the swing arm 123, is capable of applying the predetermined tension to the intermediate transfer belt 109 against the second elastic member 132 of the tension releasing part 131, to assure that the intermediate transfer belt 109 is in contact with the photosensitive bodies 111Y, 111M, 111C, 111K with the second predetermined pressure.

Alternatively, to assist swinging the tension roller 122 in a direction of coming in contact with the inner surface of the intermediate transfer belt 109 when the tension actuating part 128 is operated to apply the predetermined tension to the intermediate transfer belt 109, the tension applying part 121 may further comprise a first elastic member 127 installed with respect to the frame 101, the swing shaft 125 and the swing arm 123. The first elastic member 127 imparts a first elastic rotating force to the swing arm 123 to swing the tension roller 122 in the direction of contacting the inner surface of the intermediate transfer belt 109.

The first elastic member 127 comprises a first tension spring installed on the swing shaft 125 and having a first end 127*a* supported in a first fixing groove 124*a* positioned at the swing arm 123 and a second end 127*b* supported in a second fixing groove 129*a* of a first spring boss 129 positioned on the frame 101.

The tension releasing part 131 is provided with a second elastic member 132 and release-enabling member 159.

The second elastic member 132 is installed with respect to the frame 101 and the swing arm 123. The second elastic member 132 imparts a second elastic rotating force to the swing arm 123, to swing the tension roller 122 in a direction opposite to the direction of contacting the inner surface of the intermediate transfer belt 109.

The second elastic member 132 comprises a second tension spring installed on the second boss 123*b* of the swing arm 123 fixed on the swing shaft 125, and having a first end 132*a* supported in a third fixing groove 124*b* positioned in the swing arm 123, and a second end 132*b* supported in a fourth fixing groove 133*a* positioned in a second spring boss 133 positioned on the frame 101.

According to one aspect, the second elastic force of the second tension spring 132 is larger than the first elastic force of the first tension spring 127, to bias the tension roller 122 in the opposite direction of contacting the inner surface of the intermediate transfer belt 109, and thereby not apply the predetermined tension to the intermediate transfer belt 109.

The release-enabling member 159 pulls the swing arm 123 to swing the tension roller 122 in an opposite direction of contacting the inner surface of the intermediate transfer belt 109 after the driving motor driving the driving roller 107 of the intermediate transfer unit 100 is stopped. The release-enabling member 159 is comprises a solenoid 160 positioned on the frame 101.

The solenoid 160 allows the swing arm 123 to swing in a direction of releasing tension in that a sum of elastic force (hereinafter, reaction force (FT)) by the clutch spring 143, the second tension spring 132, and tension of the intermediate transfer belt 109 overcome the friction force (Fμ), generated between the clutch spring 143 and the first clutch boss 141*a* of the clutch gear 141 and between the clutch spring 143 and the second clutch boss 146*a* of the bushing 146, when the elastic rotating force of the second tension spring 132 is operated on the swing arm 123 to swing the tension roller 122 in an opposite direction of contacting the inner surface of the intermediate transfer belt 109 after the driving motor driving the driving roller 107 is stopped.

Figure 8:
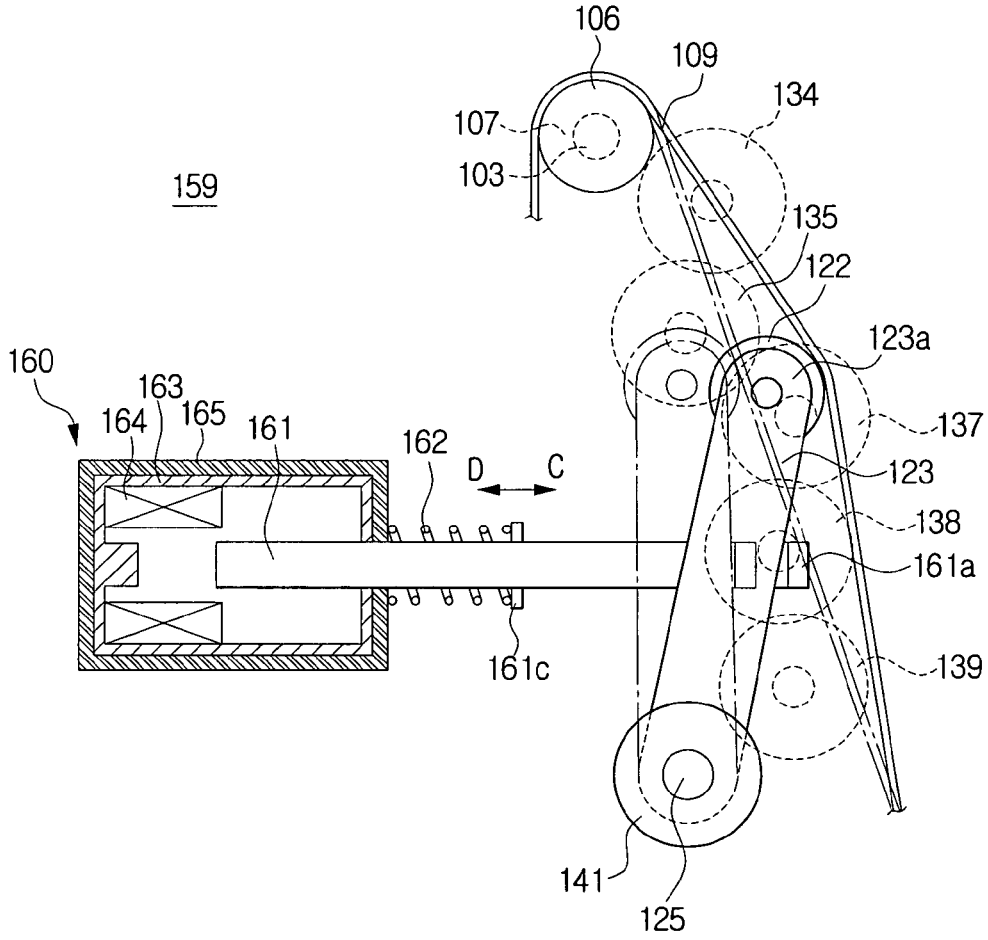
FIG. 8 is a partial cross-sectional view of a release-enabling member of a tension release part the automatic belt tension apparatus of FIG. 4.

As shown in FIG. 8, the solenoid 160 comprises a plunger 161, a coil 164, a plunger spring 162, and a casing 165.

According to one aspect, the plunger 161 comprises a magnet or a material that can be actuated by a magnetic force, and has, at a top portion, a protrusion actuating pin 161*a* bent to pull the swing arm 123.

When power is applied, the coil 164 generates a magnetic force and pulls the plunger 161 to move to the left (in an arrow D direction of FIG. 8). The coil 164 is supported by a yoke 163.

When power is not applied to the coil 164, so that magnetic force is not generated, the plunger spring 162 returns the plunger 161 to the right (in an arrow C direction of FIG. 8), and is disposed between a washer 161*c* of the plunger 161 and the right part (as shown in FIG. 8) of the casing 165.

Accordingly, when the solenoid 160 is turned on after the driving motor driving the driving roller 107 is stopped, that is, when the power is applied to the coil 164, the protrusion actuating pin 161*a* of the plunger 161 moves to the left to pull the swing arm 123 in a counterclockwise direction (relative to the swing shaft 125). Therefore, the driving force of the solenoid 160 is added to the reaction force (FT) so that the swing arm 123 can overcome the friction force (Fμ) generated between the clutch spring 143 and the first clutch boss 141*a* of the clutch gear 141 and between the clutch spring 143 and the second clutch boss 146*a* of the bushing 146, and the swing arm 123 can be rotated in a counterclockwise direction.

Additionally, when the solenoid 160 is turned off, that is, when the power is not applied to the coil 164, the protrusion actuating pin 161*a* of the plunger 161 is moved to the right by the plunger spring 162, to be separated from the swing arm 123.

Accordingly, in a condition when the solenoid 160 is continuously turned on, or when the solenoid 160 is turned off after turned on to allow the tension roller 122 to be sufficiently separated from the intermediate transfer belt 109, the tension roller 122 is maintained at a standby position shown in a dotted line of FIG. 3, which is sufficiently separated from the intermediate transfer belt 109.

The tension actuating part 128 is provided with: the tension gear 106 installed on the driving shaft 103; and the power transmitting gear train 130, comprising first, second, third, fourth, and fifth power transmitting gears 134, 135, 137, 138, and 139 connected with the tension gear 106.

The first, second, third, fourth, and fifth power transmitting gears 134, 135, 137, 138, 139 of the power transmitting gear train 130 are respectively supported on the frame 101 by first, second, third, fourth, and fifth supporting shafts 134*a*, 135*a*, 137*a*, 138*a*, and 139*a*.

In the automatic belt tension apparatus 120 according to an embodiment of the present invention having the above configuration, the relation in each operation stage of the friction force (Fμ), the reaction force (FT) and the driving load torque (Ftq) will be theoretically explained with reference to FIGS. 9A, 9B and 9C as follows. The friction force (Fμ) is generated between the clutch spring 143 and the first clutch boss 141*a* of the clutch gear 141 and the clutch spring 143 and the second clutch boss 146*a* of the bushing 146. The reaction force (FT) is composed of the sum of elastic force by tensions of the clutch spring 143, the second tension spring 132 and the intermediate transfer belt 109, and acts against the friction force (Fμ). The driving load torque operates on the clutch gear 141 of the tension clutch 140.

In the present embodiment of the present invention, friction force (Fμ) is balanced with the sum of the spring force of the clutch spring 143, the spring force of the second tension spring 132, and the elastic force from the tension of the intermediate transfer belt 109, and can be expressed by the following equation 1.

$$F\mu = kc\delta c + kt\delta t + kb\delta b \quad (1)$$

Here, kc, kt, and kb are spring constants of the clutch spring 143, the second tension spring 132, and the intermediate transfer belt 109, respectively. And δc, δt and δb are an effective displacement amount of the clutch spring 143, the second tension spring 132, and the intermediate transfer belt 109, respectively.

Additionally, the friction force (Fμ) can be divided into a static friction force and a dynamic friction force according to the sliding operation of the clutch gear 141 with respect to the clutch spring 143.

Figures 9A, 9B, 9C:
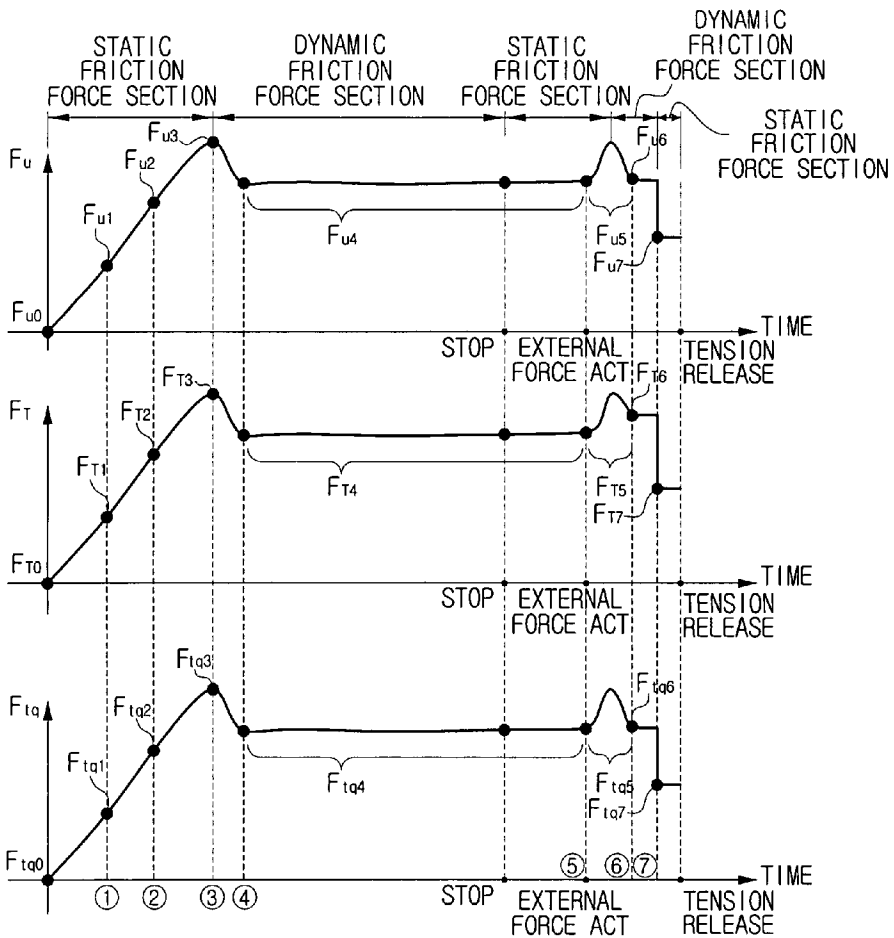
FIGS. 9A, 9B, and 9C are graphs of exemplifying the relation in operation stages of a friction force (Fμ), a reaction force (FT), and a driving load torque (Ftq) of the automatic belt tension apparatus of FIG. 4.

As shown in FIGS. 9A, 9B and 9C, when the driving motor driving the driving roller 107 is stopped, the friction force (Fμ=Fμ0) is 0, and it can be expressed by the following equation (2).

δc=δc0=0, δt=δt0=0, δb=δb0=0 (here, the values of initial δc, δt, δb are assumed to be 0)

$$F\mu = F\mu 0 = 0 \quad (2)$$

Here, the reaction force (FT=Ft0) and the driving load torque (Ftq=Frq0) are 0.

Then, when the driving motor is driven and the rotating force of the clutch gear 141 is transmitted to the bushing 146 by the driving force transmitted via the tension gear 106 of the tension actuating part 128 and the power transmitting gear train 130 from the driving motor so that the displacement amount of the clutch spring 143 becomes the maximum value δc1 (① of FIG. 9A), the friction force (Fμ=Fμ1) can be expressed by the following equation (3).

$$\delta c = \delta c1, \delta t = \delta t1 = 0, \delta b = \delta b1 = 0 \therefore F\mu = F\mu 1 = kc\delta 1 \quad (3)$$

Here, the displacement of the second tension spring 132 is assumed to occur after the displacement of the clutch spring 143 becomes maximal. But this should not be considered as limiting. The displacement may occur differently, for example, the displacement of the second tension spring may occur before the displacement of the clutch spring 143 becomes maximal.

At this time, the reaction force (FT=FT1) and the driving load torque (Ftq=Ftq1) are the same as the friction force (Fμ=Fμ1). Here, the friction force (Fμ), the reaction force (FT) and the driving load torque (Ftq) are set to the same value for the convenience of explanation.

Then, at the initial time when the swing arm 123 is rotated against the elastic force of the second tension spring 132 by the rotating of the bushing 146 so that the tension is applied to the intermediate transfer belt 109 by the tension roller 122 (② of FIG. 9A), the friction force (Fμ=Fμ2) can be expressed by the following equation (4).

$$\delta c = \delta c2 = \delta c1, \delta t = \delta t2, \delta b = \delta b2 = 0 \therefore F\mu = F\mu 2 = kc\delta c1 + kt\delta t2 \quad (4)$$

Also, the reaction force (FT=FT2) and the driving load torque (Ftq=Ftq2) are the same as the friction force (Fμ=Fμ2).

Then, just before the clutch spring 143 is slipped, that is, until the time when the maximum friction force based on the static friction force acts (③ of FIG. 9A), the effective displacement amounts δt, δb of the second tension spring 132 and the intermediate transfer belt 109 are increased by predetermined value so that the friction force (Fμ=Fμ3) becomes maximal and can be expressed by the following equation (5). Here, the tension of the intermediate transfer belt 109 becomes maximal.

$$\delta c = \delta c3, = \delta c1, \delta t = \delta t3 (\geqq \delta t1), \delta b = \delta b3 \therefore F\mu = F\mu 3 = kc\delta c1 + kt\delta t3 + kb\delta b3 \quad (5)$$

Also, the reaction force (FT=FT3) and the driving load torque (Ftq=Ftq3) are the same as the friction force (Fμ=Fμ3).

Then, the first end 143*a* of the clutch spring 143 is slipped by a predetermined range and the clutch gear 141 transmits only a portion of the rotating force (i.e., within a predetermined range) to the bushing 146 (④ of FIG. 9A), and accordingly, the friction force ((Fμ=Fμ4), which is a dynamic friction force, is reduced to a predetermined range. At this time, the friction force (Fμ=Fμ4) can be expressed by the following equation (6).

$$\delta c = \delta c4 (\leqq \delta c1), \delta t = \delta t4 (\leqq t3), \delta b = \delta b4 (\leqq \delta b3) \therefore F\mu = F\mu 4 = kc\delta c4 + kt\delta t4 + kb\delta b4 \quad (6)$$

Also, the reaction force (FT=FT4) and the driving load torque (Ftq=Ftq4) are the same as the friction force (Fμ=Fμ4).

Here, the friction force (Fμ=Fμ4) and the reaction force (FT=FT4) are balanced so that the tension force acting on the intermediate transfer belt 109 is maintained as a predetermined design value.

Then, when the printing is completed and the driving motor is stopped, the friction force (Fμ=Fμ4) is maintained as the friction force (Fμ=Fμ4) expressed as the above equation (6) by the gear force from the driving motor.

Also, the reaction force (FT=FT4) and the driving load torque (Ftq=Ftq4) are the same as the friction force (Fμ=Fμ4).

Then, when the solenoid 160 is turned on and the protrusion actuating pin 161*a* of the plunger 161 pulls the swing arm 123 in a counterclockwise direction with respect to swing shaft 125 (⑤ of FIG. 9A), the rotating force of the bushing 146 exceeds predetermined range of the load torque by external force Fex actuated by the solenoid 160. The bushing 146 is rotated through the swing arm 123. Therefore, the first end 143*a* of the clutch spring 143 is slipped and the effective displacements of the clutch spring 143, the second tension spring 132, the intermediate transfer belt 109 are reduced, respectively. Accordingly, the swing arm 123 is rotated in a direction in which the tension roller 122 releases the tension. The section on which the external force Fex acts by the solenoid 160, can be properly set within a range until the tension roller 122 is sufficiently separated from the intermediate transfer belt 109.

Accordingly, the tension roller 122 is separated from the intermediate transfer belt 109 as much as the distance in which the protrusion actuating pin 161*a* of the plunger 161 of the solenoid 160 pulls the swing arm 123 in a counterclockwise direction.

At this time, the external force is added to the reaction force so that the magnitude of reaction force increases. Accordingly, the friction force (Fμ=Fμ5) increases to the same value as the maximal friction force (Fμ=Fμ3) of the above equation (5) till the first end 143*a* of the clutch spring 143 is slipped. When, by the increase of the reaction force, the first end 143*a* of the clutch spring 143 is slipped by predetermined range so that the clutch gear 141 transmits only the rotating force of predetermined range to the bushing 146 and the tension roller 122 is separated from the intermediate transfer belt 109 (⑥ of FIG. 9A), the friction force is maintained as the same value (Fμ=Fμ6) as the friction force (Fμ=Fμ4) of the above equation (6). According to one aspect, the reaction force (FT6) is designed to be greater than the Fμ6 by a predetermined value.

Then, when the tension of the intermediate transfer belt 109 is completely released and the tension roller 122 is separated from the intermediate transfer belt 109 so that the elastic force by the tension of the intermediate transfer belt 109 disappears and a predetermined value of the elastic force of the second tension spring 132 remains at a predetermined range (⑦ of FIG. 9A), the reaction force is maintained as predetermined value FT7 and the friction force is also maintained as predetermined value Fμ7.

The driving load torque (Ftq=Ftq5) increases to the same value as the maximal driving load torque (Ftq=Ftq3) and then is maintained as the same value (Ftq=Ftq6) as the driving load torque (Ftq=Ftq4). Then, the driving load torque is maintained as predetermined value (Ftq=Ftq7).

When the tension of the intermediate transfer belt 109 is completely released, the friction force (Fμ=Fμ7), the reaction force (FT=Ft7), and the driving load torque (Ftq=Ftq7) are balanced with one another (Fμ7=Ft7=Ftq7).

According to one aspect, the friction force (Fμ=Fμ7), the reaction force (FT=Ft7), and the driving load torque (Ftq=Ftq7) are set between the value (Fμ1, FT1, Ftq1) and the value (Fμ2, FT2, Ftq2) when the tension roller 122 is separated from the intermediate transfer belt 109 so that the elastic force from the tension of the intermediate transfer belt 109 disappears and the elastic force of the second tension spring 132 remains at the predetermined range. But this should not be considered as limiting. The friction force, the reaction force and the driving load torque may be implemented such that, according to the acting range of the external force Fex exerted by the solenoid 160, all of the elastic force by the tension of the intermediate transfer belt 109, the elastic force of the second tension spring 132 and the elastic force of the clutch spring 143 disappear, so that Fμ7=FT7=Ftq7=0.

In the first embodiment of the present invention described above, the automatic transfer belt tension apparatus 120 of the electrophotographic color printer is illustrated and explained as only applying the tension to the intermediate transfer belt 109 in the intermediate transfer unit 100, but the present invention is not limited to this, and may also applied to any other apparatus using a transfer belt, for example, a transfer unit (not shown) having a transfer belt (not shown) which directly transfers the toner images formed on the photosensitive bodies 111Y, 111M, 111C, 111K onto a sheet of paper.

Additionally, the automatic belt tension apparatus 120 of the electrophotographic color printer according to the first embodiment is illustrated and explained as having the solenoid 160 as the release-enabling member 159 of the tension releasing part 131. But this should not be considered as limiting.

For example, the release-enabling member 159' (see FIGS. 10A and 10B) may be configured as one way power transmitting part 180 that is disposed between the driving motor and the clutch gear 141 to transmit the driving force of the driving motor only toward the clutch gear 141.

Figure 10A:
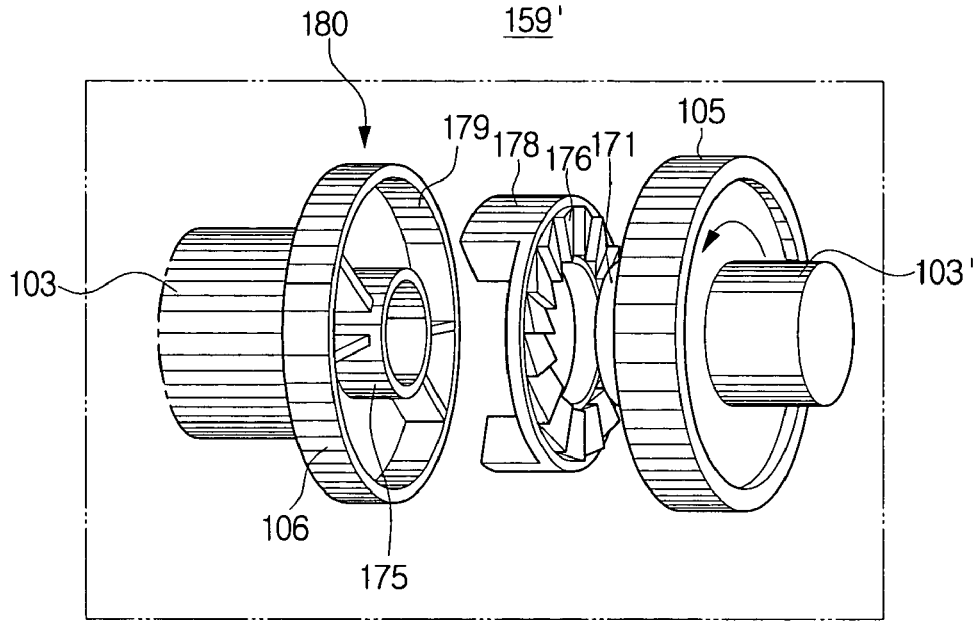
FIGS. 10A and 10B are partial perspective views of another example of a release-enabling member of the tension release part of the automatic belt tension apparatus of FIG. 4.
Figure 10B:
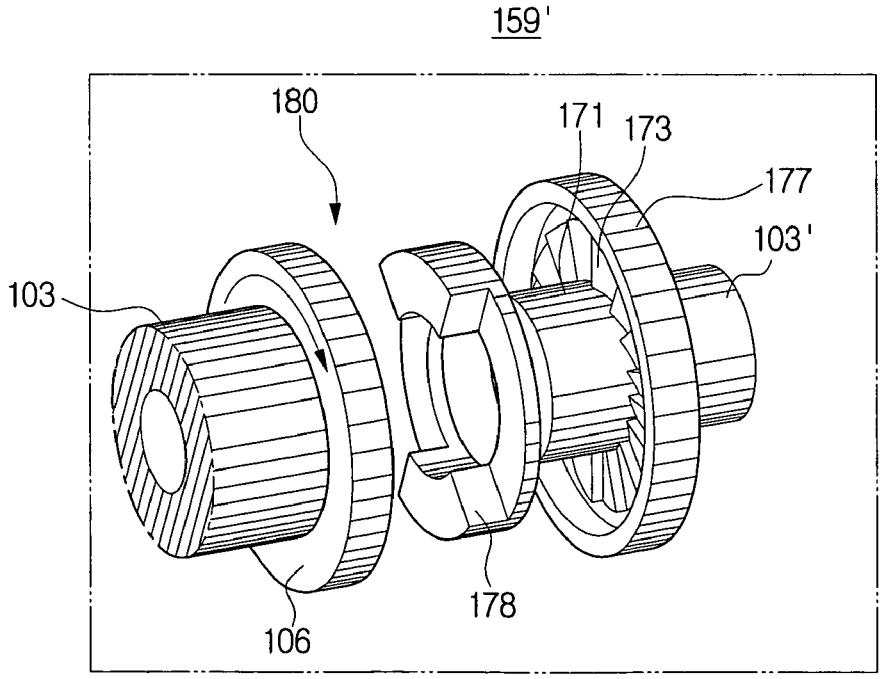

FIGS. 10A and 10B are views of one example of the one way power transmitting part 180.

When the reaction force (FT) based on the tension of the clutch spring 143, the second tension spring 132, and the intermediate transfer belt 109 is supported by the friction force Fμ generated between the clutch spring 143 and the first clutch boss 141*a* of the clutch gear 141 and between the clutch spring 143 and the second clutch boss 146*a* of the bushing 146, the one way power transmitting part 180 removes the supporting force supporting the friction force (Fμ) so that the tension roller 122 of the swing arm 123 can be separated from the intermediate transfer belt 109 by the reaction force (FT).

As shown in FIGS. 10A and 10B, the one way power transmitting part 180 is disposed between the tension gear 106 and the driving gear 105.

The one way power transmitting part 180 comprises a first rotation boss 171, a first ratch saw tooth 173, a first fixing boss 175 and a second ratch saw tooth 176.

The first rotation boss 171 is positioned on the driving gear 105. The first fixing boss 175 and the second ratch saw tooth 176 are positioned at one side of the tension gear 106. The driving gear 105 is positioned at one side of a coupling shaft 103' which is configured separately from the driving shaft 103.

The second ratch saw tooth 176 is rotatably supported within a range of predetermined angle in a bracket receiving recess 179 by a fixing bracket 178. The bracket receiving recess 179 is positioned at one side of the tension gear 106.

The first ratch saw tooth 173 and the second ratch saw tooth 176 are configured to be meshed with each other so that the power is transmitted from the first ratch saw tooth 173 to the second ratch saw tooth 176, and from the second ratch saw tooth 176 to the first ratch saw tooth 173 when the driving gear 105 is rotated in one direction, for example, in a clockwise direction of FIG. 10A and when the tension gear 106 is rotated in a counterclockwise direction. When the driving gear 105 is rotated in another direction, for example, in a counterclockwise direction and the tension gear 106 is rotated in a clockwise direction, the first ratch saw tooth 173 and the second ratch saw tooth 176 are configured to be alternated or slipped with each other so that the power is cut from the first ratch saw tooth 173 to the second ratch saw tooth 176 and from the second ratch saw tooth 176 to the first ratch saw tooth 173.

Accordingly, when an elasticity rotating force of the second tension spring 132 acts on the swing arm 123 to swing the tension roller 122 in an opposite direction of contacting the inner surface of the intermediate transfer belt 109 after the driving motor driving the driving roller 107 is stopped, the elasticity rotating force of the second tension spring 132 transmitted via the tension clutch 140 and the power transmitting gear train 130 to the tension gear 106 is not transmitted to the driving gear 105 by the one way power transmitting part 180. In other words, when the swing arm 123 is separated from the intermediate transfer belt 109 by the reaction force FT including the elasticity rotating force of the second tension spring 132, the rotating force acting on the tension gear 141 is not transmitted to the driving gear 105 by the one way power transmitting part 180, so that the tension gear 141 idles. At this time, the tension gear 141 rotates and stops till the reaction force FT becomes 0, that is, till the effective displacement amounts δc, δt, δb of the clutch spring 143, the second tension spring 132 and the intermediate transfer belt 109 become 0.

Here, the one way power transmitting part 180 is explained and exemplified as a gear type employing the first ratch saw tooth 173 and the second ratch saw tooth 176. But this should not be considered as limiting. The one way power transmitting part 180 may be configured as a well-known one way bearing that employs saw tooth disposing between bearings to transmit power in one direction.

Figure 11:
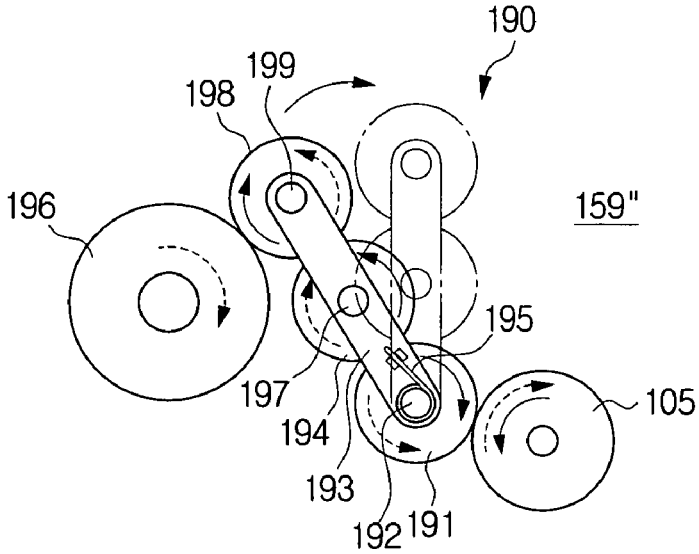
FIG. 11 is a partial cross sectional view of yet another example of a release-enabling member of the tension release part of the automatic belt tension apparatus of FIG. 4.

FIG. 11 is a view of a swing gear part 190 as yet another embodiment of the release-enabling member (159").

Swing gear part 190 is disposed between a power transmitting gear 196 and the driving gear 105. The power transmitting gear 196 is connected to the gear train transmitting the power from the driving motor.

Like the one way power transmitting part 159', when the reaction force (FT) based on the tension of the clutch spring 143, the second tension spring 132, and the intermediate transfer belt 109 is supported by the friction force Fμ generated between the clutch spring 143 and the first clutch boss 141*a* of the clutch gear 141 and between the clutch spring 143 and the second clutch boss 146*a* of the bushing 146, the swing gear part 190 removes the supporting force supporting the friction force (Fμ) so that the tension roller 122 of the swing arm 123 can be separated from the intermediate transfer belt 109 by the reaction force (FT).

As shown in FIG. 11, the swing gear part 190 comprises a rotation gear 191, a first and a second swing gear 194, 198, a swing lever 193 and a torsion spring 195.

The rotation gear 191 is rotatably fixed on a fixing shaft 192 to be meshed with the driving gear 105.

The first and the second swing gears 194, 198 are rotatably supported by first and second supporting shafts 197, 199, respectively positioned on the swing lever 193. The swing lever 193 is rotatably fixed on the fixing shaft 192.

The torsion spring 195 is positioned on the fixing shaft 192, and opposite ends thereof are respectively supported by the swing lever 193 and the fixing shaft 192, to bias the swing lever 193 in a direction of meshing the second swing gear 198 with power transmitting gear 196.

Accordingly, because of the elastic force of the torsion spring 195, when driving gear 105 is rotated in a clockwise direction (shown in dotted line in FIG. 11), power is transmitted via the second swing gear 198 meshed with the power transmitting gear 196, the second swing gear 194, and the rotation gear 191 from the driving gear 105 so that the power transmitting gear 196 is rotated in the a clockwise direction shown in a dotted line of FIG. 11. Conversely, when the driving gear 105 is rotated in a counterclockwise direction shown in a solid line of FIG. 11 by the tension gear 106, the swing lever 193 is rotated in a clockwise direction, with respect to the fixing shaft 192, against the elastic force of the torsion spring 195, so that the power is cut from the rotation gear 191 to the power transmitting gear 196. The swing lever 193 is rotated by the clockwise rotation of the rotating gear 191.

Accordingly, when the elastic force of the second tension spring 132 acts on the swing arm 123 to swing the tension roller 122 in an opposite direction of contacting the inner surface of the intermediate transfer belt 109 after the driving motor driving the driving roller 107 is stopped, the elasticity rotation force of the second tension spring 132 transmitted via the tension clutch 140, the power transmitting gear train 130, and the tension gear 106 to the driving gear 105, is not transmitted to the power transmitting gear 196 by the swing gear part 190. As a result, the tension clutch 140, the power transmitting gear train 130, the tension gear 106 and the driving gear 105 are idled by the elastic force of the second tension spring 132 without receiving the gear force from the driving motor.

Figure 13:
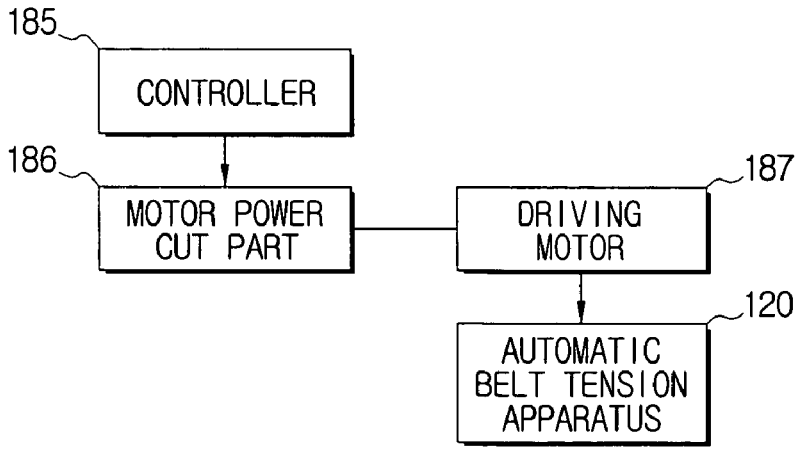
FIG. 13 is a block diagram of also another example of a release-enabling member of the tension release part of the automatic belt tension apparatus of FIG. 4.

The release-enabling member according to also another embodiment of the present invention may be configured as a motor power cut part (186) cutting electric power to the driving motor 187 under control of a controller 185 when the printing is completed and the driving motor 187 driving the driving roller 107 is stopped, as shown in FIG. 13. The driving motor 187 is assumed not to have a brake function. The motor power cut part 186 is configured as an electric power cut circuit cutting the electric power of the driving motor 187 from an electric power source (not shown) when the printing is completed and the driving motor 187 is stopped.

At this time, when the electric power of the driving motor 187 is cut, the driving motor 187 is freely rotated, to not impart the gear force on the tension gear 106 of the tension actuating part 128, the power transmitting gear train 130 and the tension clutch 140. Accordingly, when the elasticity rotation force of the second tension spring 132 acts on the swing arm 123 to swing the tension roller 122 in an opposite direction of contacting with the inner surface of the intermediate transfer belt 109, the swing arm 123 is freely swung in an opposite direction of contacting the inner surface of the intermediate transfer belt 109 by the elastic force of the second tension spring 132. Therefore, the tension roller 122 is separated from the inner surface of the intermediate transfer belt 109.

If the one way power transmitting part 180, the swing gear part 190 or the motor power cut part 186 are applied to the release-enabling member 159', 159", the relation in the operation stages of the friction force (Fμ'), the reaction force (FT'), and the driving load torque (Ftq') will be explained with reference to FIGS. 12A, 12B and 12C as follows. The friction force (Fμ') is generated between the clutch spring 143 and the first clutch boss 141*a* of the clutch gear 141 and the clutch spring 143 and the second clutch boss 146*a* of the bushing 146. The reaction force (FT') comprises the sum of elastic force by tensions of the clutch spring 143, the second tension spring 132 and the intermediate transfer belt 109, and acts against the friction force (Fμ'). The driving load torque Ftq' operates on the clutch gear 141 of the tension clutch 140.

Figures 12A, 12B, 12C:
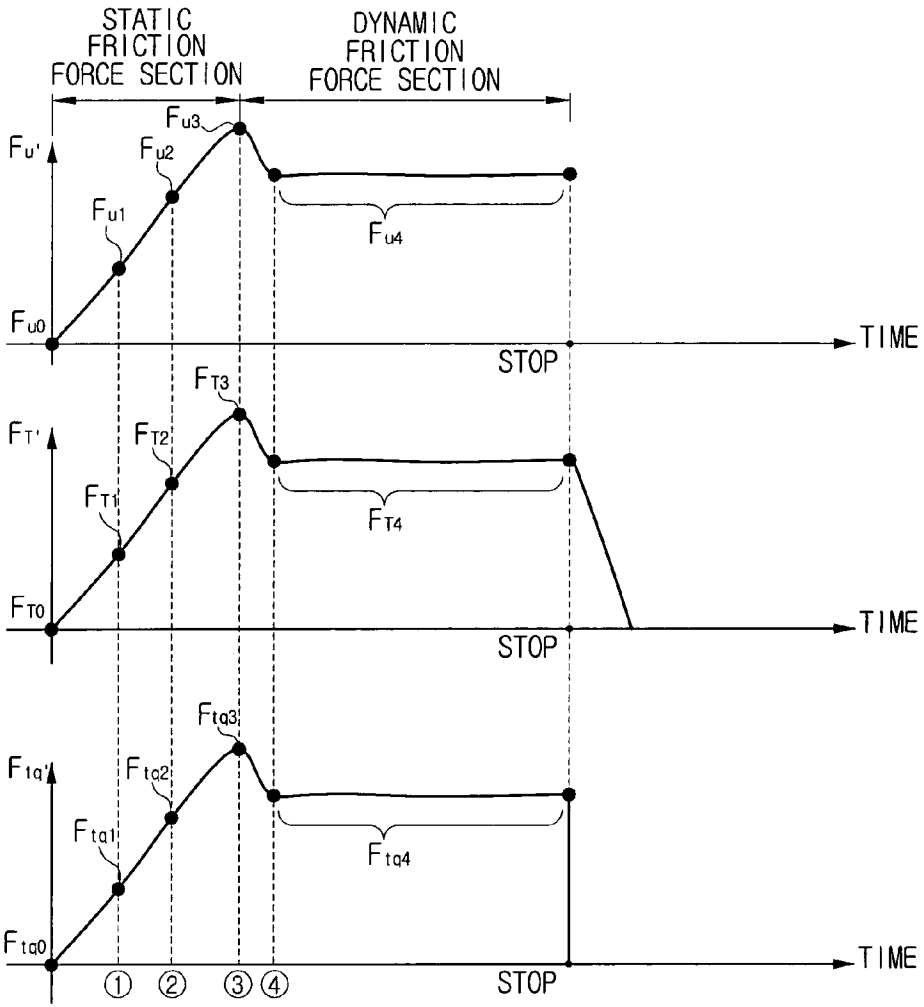
FIGS. 12A, 12B and 12C are graphs of exemplifying the relation in operation stages of a friction force (Fμ'), a reaction force (FT'), and a driving load torque (Ftq') of the automatic belt tension apparatus employing the release-enabling member of FIGS. 10A through 11.

As shown in FIGS. 12A, 12B and 12C, the friction force (Fμ'), the reaction force (FT'), and the driving load torque (Ftq') are the same as those explained with reference to FIGS. 9A, 9B and 9C until the driving motor is stopped when the printing is completed.

Then, when the driving motor is stopped, the driving load torque (Ftq') acting on the clutch gear 141 is removed by the one way power transmitting part 180, the swing gear part 190, or the motor power cut part, and accordingly, the friction force (Fμ') does not act any more.

The reaction force (FT') is proportionally reduced as the effective displacement amounts δc, δt and δb of the clutch spring 143, the second tension spring 132 and the intermediate transfer belt 109 become closer to 0.

Accordingly, the tension roller 122 is separated from the intermediate transfer belt 109 by the elastic force of the second tension spring 132. The operation of the automatic belt tension apparatus 120 of the intermediate transfer unit 100 according to the first preferred embodiment of the present invention constructed as above will now be explained in great detail with reference to FIGS. 3 through 5, and 8.

Firstly, after toner imagers are formed on the photosensitive bodies 111Y, 111M, 111C, 111K in a known manner in the art, to change the toner images into a first transfer image, the driving roller 107 of the intermediate transfer unit 100 is rotated in one direction, for example, a clockwise direction by a driving gear 105 connected with the driving motor through a gear train (not shown), as is shown in the embodiment depicted in FIG. 3.

As the driving roller 107 rotates, the intermediate transfer belt 109 begins to rotate along the supporting and backup roller 113 and 115 and the second transfer backup roller 108, coming in contact with the photosensitive bodies 111Y, 111M, 111C, 111K and the transfer roller 117, and at the same time, the tension gear 106 positioned on the driving shaft 103 rotates in the clockwise direction.

As the tension gear 106 rotates, the first, second, third, fourth, and fifth power transmitting gears 134, 135, 137, 138, and 139 of the power transmitting gear train 130 connected with the tension gear 106, sequentially rotate, and as a result, the clutch gear 141 engaged with the fifth power transmitting gear 139 rotates in the winding direction of the clutch spring 143, i.e., the clockwise direction of FIG. 3.

As described above, when the clutch gear 141 rotates in the clockwise direction, the clutch spring 143, supported by the first and the second supports 141*b* and 146*b* at the first and the second ends 143*a* and 143*b* thereof, comes in tight contact with the outer circumferential surfaces of the first and the second clutch bosses 141*a* and 146*a*, while the inner diameter of the clutch spring 143 gets smaller and generates a sliding friction force with the first and the second clutch bosses 141*a* and 146*a*, so that a rotating force of the first clutch boss 141*a* of the clutch gear 141 is transferred to the second clutch boss 146*a* of the bushing 146, near the clutch gear 141.

The rotating force of the clutch gear 141, transmitted to the second clutch boss 146*a* of the bushing 146 as described above, is transmitted to the swing arm 123 through the swing shaft 125, and as a result, the swing arm 123 swings the tension roller 122 from a standby position, shown in a dotted line in FIG. 3, to a tension position, shown in a solid line in FIG. 3, against an elastic force of the second elastic member 132 of the tension releasing part 131.

At this time, the first elastic member 127 of the tension applying part 121 assists rotation of the swing shaft 125 in the clockwise direction against the elastic force of the second elastic member 132 of the tension releasing part 131, so that the swing arm 123 can more easily swing in the clockwise direction.

As the swing arm 123 swings as described above, the tension roller 122, rotatably supported on the first boss 123*a* of the swing arm 123, presses the inner surface of the intermediate transfer belt 109 in a direction of arrow A in FIG. 3, to apply the predetermined tension thereto.

After that, when the tension roller 122 is no longer swung, and is stopped by the tensioned intermediate transfer belt 109, the clutch gear 141 connected with the tension roller 122 through the swing arm 123 and the swing shaft 125 is no longer rotated, thereby generating a driving load by the driving force from the power transmitting gear train 130.

When the driving load of the clutch gear 141 generated as above exceeds the range of the predetermined load torque, i.e., the limit set to enable the intermediate transfer belt 109 to be in contact with the photosensitive bodies 111Y, 111M, 111C, 111K with the second predetermined pressure, the first end 143*a* of the clutch spring 143 does not stand the excess driving load of the clutch gear 141, and slips over the first support 141*b*, and thereby, the circumferential surface of the first clutch boss 141*a* no longer comes in tight contact with the clutch spring 143, and slides therein to idle the clutch gear 141.

At this time, since the friction force between the clutch spring 143 and the circumferential surfaces of the first and the second clutch bosses 141*a* and 146*a* is not completely removed, but maintained to the extent to allow only the idling of the clutch gear 141, the intermediate transfer belt 109 remains in contact with the photosensitive bodies 111Y, 111M, 111C, 111K with the second predetermined pressure.

Also, under this condition, if the driving load of the clutch gear 141 falls below the range of the predetermined load torque, due to moving or shaking of the intermediate transfer belt 109 by an external force and the like, the first end 143*a* of the clutch spring 143 stops slipping over the first support 141*b*, and thereby the clutch spring 143 is again coiled in the winding direction thereof by the rotation of the clutch gear 141. Consequently, the clutch spring 143 comes in tight contact with the outer circumferential surfaces of the first and the second clutch bosses 141*a* and 146*a* while the inner diameter of the clutch spring 143 gets smaller, and generates the sliding friction force so as not to allow the first clutch bosses 141*a* of the clutch gear 141 to slide and idle therein, so that the rotating force of the first clutch boss 141*a* of the clutch gear 141 is again transferred to the second clutch boss 146*a* of the bushing 146 nearby the clutch gear 141.

Thereafter, when the driving load of the clutch gear 141 again exceeds the range of the predetermined load torque, the tension clutch 140 operates the clutch gear 141 to idle in the clutch spring 143 in the same manner as is described above.

As described above, while the intermediate transfer belt 109 comes in contact with the photosensitive bodies 111Y, 111M, 111C, 111K with the second predetermined pressure, the toner images formed on the photosensitive bodies 111Y, 111M, 111C, 111K by the image forming units for the yellow, cyan, magenta, and black colors is transferred onto an outer surface of the intermediate transfer belt 109, which is rotating at the same speed as the photosensitive bodies by the driving roller 107, and changed into a first transfer image.

After that, the first transfer image, transferred onto the outer surface of the intermediate transfer belt 109, is transferred in the known manner in the art onto a sheet of paper conveyed by a paper feeding unit (not shown) through the transfer roller 117 of the second transfer unit. The sheet of paper with the transferred image is then moved to the fusing unit to fix the transferred image on the sheet of paper, and is then discharged to the outside.

As described above, after the printing is completed, when the driving motor driving the driving roller 107 of the intermediate transfer unit 100 is stopped and the solenoid 160 is turned on so that the protrusion actuating pin 161*a* of the plunger 161 pulls the swing arm 123 in a counterclockwise direction with respect to the swing shaft 125, as explained with reference to FIGS. 9A through 9C, the rotating force of the bushing 146 exceeds predetermined range of the load torque by the external force (Fex) exerted by the solenoid 160. The bushing 146 is rotated via the swing arm 123. Therefore, the first end 143*a* of the clutch spring 143 is slipped and the effective displacements of the clutch spring 143, the second tension spring 132, the intermediate transfer belt 109 are reduced, respectively. Accordingly, the swing arm 123 is rotated in a direction of releasing the tension by the tension roller 122.

Accordingly, the tension roller 122 is separated from the intermediate transfer belt 109 as much as the distance in which the protrusion actuating pin 161*a* of the plunger 161 of the solenoid 160 pulls the swing arm 123 in a counterclockwise direction, to be moved from the tension position shown in the solid line to the standby position shown in the dotted line of FIG. 3. Accordingly, the tension of the intermediate transfer belt 109, on which the tension roller 122 acts, is released.

Embodiment 2

Figure 6:
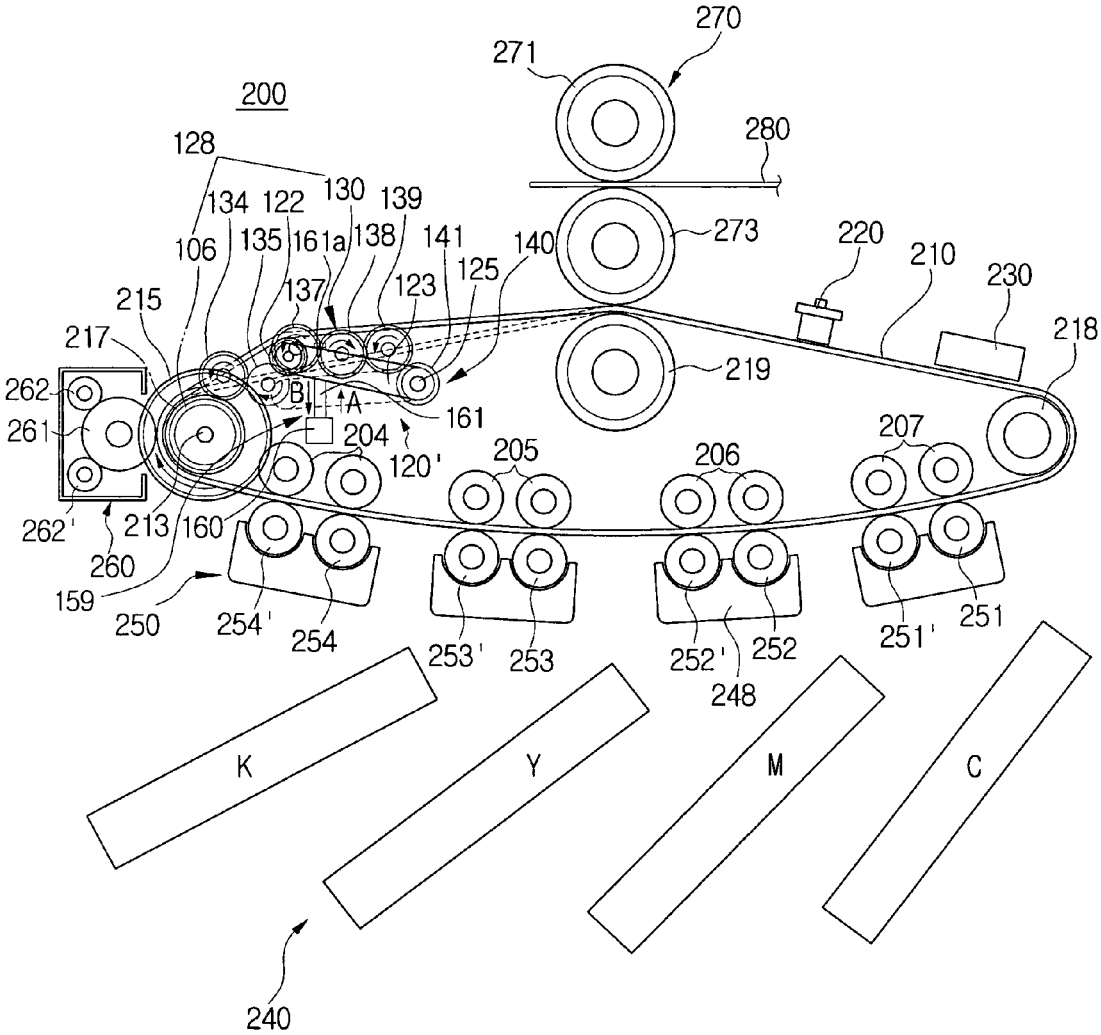
FIG. 6 is a schematic side elevation view of a wet electrophotograph color printer with an automatic belt tension apparatus according to a second embodiment of the present invention.

Referring to FIG. 6, there is schematically illustrated a wet electrophotograph color printer 200 to which an automatic belt tension apparatus 120' is applied according to a second embodiment of the present invention.

The wet electrophotograph color printer 200 comprises: a photosensitive belt 210 rotating along an endless path by driving, backup, and driven rollers 217, 219, and 218, respectively: an erasing unit 220 to remove electric potential remaining on a surface of the photosensitive belt 210, that is disposed over a side of the photosensitive belt 210; a charging unit 230 to electrify the surface of the photosensitive belt 210, from which the remaining electric potential has been removed, with a predetermined electric potential; a laser scanning unit 240 to scan a laser beam, modulated according to an image signal, onto the surface of the photosensitive belt 210, to form an electrostatic latent image thereon; a developing unit 250 to develop the electrostatic latent image into a visible image by supplying a developer 248, in which a solid toner is mixed with a liquid carrier, to the surface of the photosensitive belt 210, and attaching only the solid toner contained in the developer 248 on the electrostatic latent image and removing the liquid carrier contained in the developer 248; a drying unit 260 to absorb the liquid carrier remaining in the solid toner attached on the electrostatic latent image, and dry and remove the absorbed liquid carrier; a transfer and fusing unit 270 to transfer the solid toner attached on the electrostatic latent image onto a sheet of paper 280 and then fix it on the sheet of paper 280; and the automatic belt tension apparatus 120' to automatically apply a predetermined tension to the photosensitive belt 210 only when the photosensitive belt 210 is driven by the driving roller 217.

The laser scanning unit 240 and the developing unit 250 are respectively comprised of four laser scanning parts Y, M, C, and K, performing color printing, and four developing parts, developing the developer 248 of four colors such as black, yellow, cyan, and magenta. Each of the developing parts has developing and backup rollers 251, 252, 253, and 254; 204, 205, 206, and 207 to attach the developer 248 to the electrostatic latent image formed on the photosensitive belt 210, and a squeeze roller 251', 252', 253' and 254' to compress the developer 248 attached on the electrostatic latent image of the photosensitive belt 210, to change the solid toner contained in the developer 248 into an image film, i.e. a toner image, and to remove the liquid carrier except for the solid toner contained in the developer 248 when the developer 248 is supplied on the photosensitive belt 210.

The drying unit 260 is provided with a dry roller 261 to absorb the liquid carrier that is not removed from the solid toner, attached on the electrostatic latent image, by the squeeze rollers 251', 252', 253' and 254', and regeneration rollers 262, 262' to heat and vaporize the absorbed liquid carrier.

The transfer and fusing unit 270 comprises a transfer roller 273, to receive the solid toner formed as the toner image on the photosensitive belt 210 and to transfer it onto the sheet of paper 280; and a pressing roller 271 to press the sheet of paper 280 against the transfer roller 273 with a high temperature and a high pressure, and at the same time, fuse the toner image transferred on the sheet of paper 280 and fix it thereon.

Figure 7:
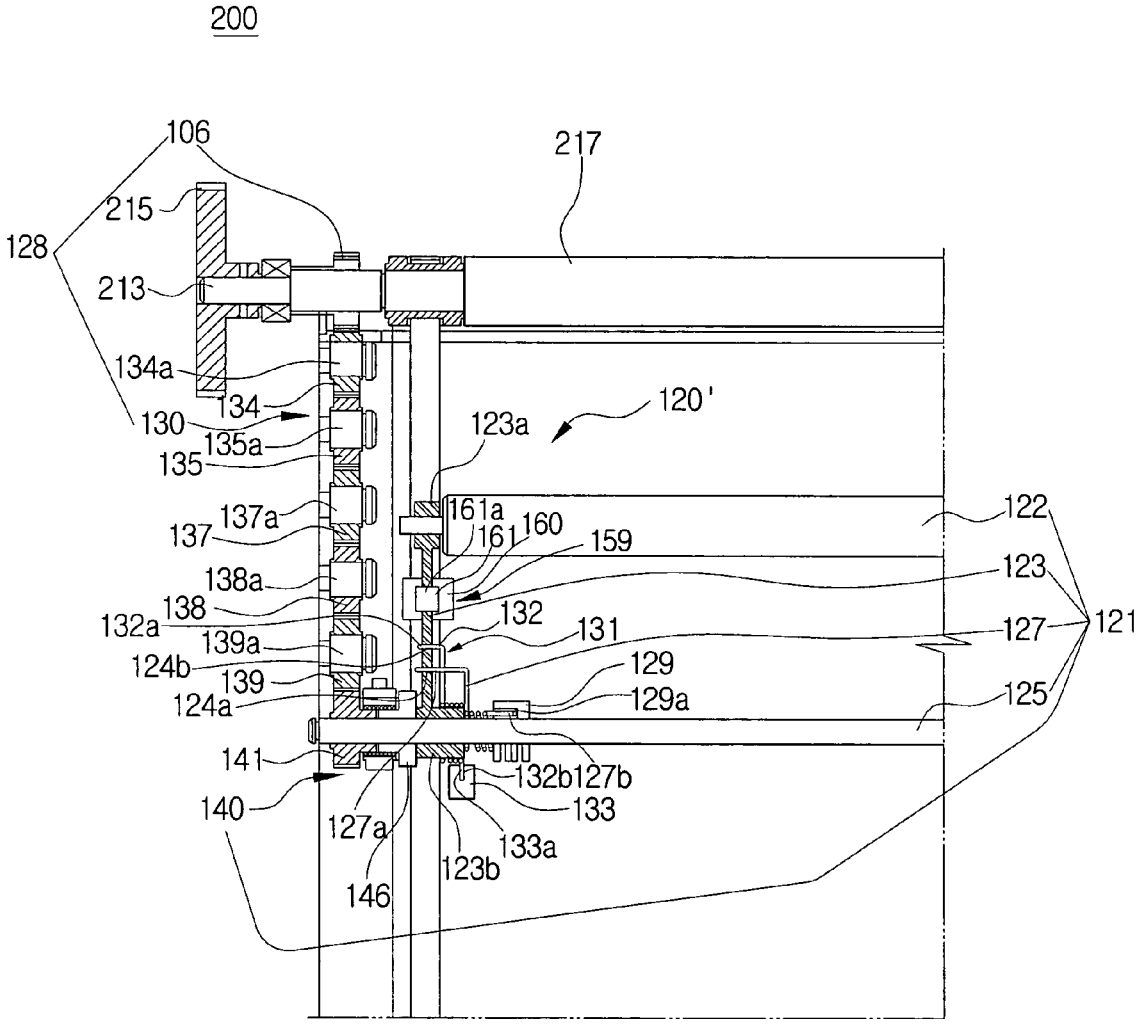
FIG. 7 is a partial front elevation view of the automatic belt tension apparatus of FIG. 6.

As shown in FIG. 7, the automatic belt tension apparatus 120' comprises: the tension applying part 121 applying the predetermined tension to the photosensitive belt 210, that is installed with respect to the photosensitive belt 210; the tension releasing part 131 operating the tension applying part 121 to not apply the predetermined tension to the photosensitive belt 210, that is installed with respect to the tension applying part 121; and the tension actuating part 128 actuating the tension applying part 121 to apply the predetermined tension to the photosensitive belt 210 against the tension releasing part 131 when a driving shaft 213 is rotated by a driving gear 215, that is connected to the driving shaft 213 to operate by the driving shaft 213 supporting the driving roller 217, to drive the photosensitive belt 210.

The description of the tension applying part 121, the tension releasing part 131, and the tension actuating part 128 will be omitted here, as it is identical to that of the automatic belt tension apparatus 120 that is described above with reference to FIGS. 4 and 5.

The operation of the wet electrophotograph color printer 200 having the automatic belt tension apparatus 120' according to the second embodiment of the present invention constructed as above will now be explained in great detail with reference to FIGS. 6 through 7.

Firstly, according to a printing command, the driving roller 217 is rotated in one direction, for example, a clockwise direction, as shown in FIG. 6, by a driving gear 215 connected with a driving motor (not shown) through a gear train (not shown).

As the driving roller 217 rotates in the clockwise direction, the photosensitive belt 210 begins to rotate in the clockwise direction along the backup and driven rollers 219 and 218, and at the same time, the tension gear 106, positioned on the driving shaft 213 of the driving roller 217, rotates in the clockwise direction.

As the tension gear 106 rotates in the clockwise direction, the swing arm 123, which is connected with the tension gear 106 through the power transmitting gear train 130, the clutch gear 141, the bushing 146, and the swing shaft 125, is swung in a direction of arrow A in the same manner as that of the automatic belt tension apparatus 120 of the first embodiment explained with reference to FIGS. 3 through 5. Thus, the tension roller 122, connected to the swing arm 123, is moved from a standby position, shown in the dotted line in FIG. 6, to the tension position, shown in the solid line in FIG. 6, against the elastic force of the second elastic member 132.

As a result, the photosensitive belt 210 is maintained in a state of coming in contact with the transfer roller 273, the developing rollers 251, 252, 253, and 254, the squeeze rollers 251', 252', 253', and 254' and the like in a predetermined pressure.

Under this condition, as the photosensitive belt 210 rotates in the clockwise direction, an electrostatic latent image corresponding to an image to be printed is formed on the photosensitive belt 210 by the charging unit 230 and the laser scanning unit 240. And the developer 248, composed of a solid toner and a liquid carrier, is attached on the electrostatic latent image due to the operation of the developing rollers 251, 252, 253, and 254 of the developing unit 250. As a result, the developer 248 forms a visible image on the area of the photosensitive belt 210 on which the electrostatic latent image is formed.

And then, the developer 248 attached on the electrostatic latent image of the photosensitive belt 210 by the developing rollers 251, 252, 253, and 254 is compressed by the squeeze rollers 251', 252'. 253', and 254', so that the solid toner contained in the developer 248 is changed into an image film, i.e. a toner image, and the liquid carrier, except for the solid toner contained in the developer 248, is removed.

Thereafter, liquid carrier components remaining in the solid toner changed into the toner image are absorbed and removed by the dry roller 261, and the toner image is transferred from the photosensitive belt 210 to the transfer roller 273 by a transfer voltage of the transfer roller 273 and a pressure of the backup roller 219.

Then, the toner image transferred to the transfer roller 273 is re-transferred onto a sheet of paper 280 and at the same time fused thereon by the pressing roller 271 which presses the sheet of paper 280 to the transfer roller 273 with a high pressure and a high temperature, applying a predetermined transfer voltage thereto. As a result, the toner image is fixed on the sheet of paper 280, and thus, a desired image is formed on the sheet of paper 280.

Additionally, after the toner image is transferred from the photosensitive belt 210 to the transfer roller 273, as the photosensitive belt 210 is continuously rotated in the clockwise direction by the driving roller 217, the electric potential on the surface of the photosensitive belt 210 is removed by the erasing unit 220.

Thereafter, the photosensitive belt 210 repeats the above described processes to form and develop an electrostatic latent image to be printed next through the charging unit 230, the laser scanning unit 240 and the developing unit 250.

As described above, after the printing is completed, when the driving motor driving the driving roller 217 is stopped and the solenoid 160 is turned on so that the protrusion actuating pin 161*a* of the plunger 161 pulls the swing arm 123 in a counterclockwise direction based on the swing shaft 125, as explained with reference to FIGS. 9A through 9C, the rotating force of the bushing 146 exceeds predetermined range of the load torque by the external force (Fex) exerted by the solenoid 160. The bushing 146 is rotated by the swing arm 123. Therefore, the first end 143*a* of the clutch spring 143 is slipped and the effective displacements of the clutch spring 143, the second tension spring 132, the photosensitive belt 210 are reduced, respectively. Accordingly, the swing arm 123 is rotated in a direction of releasing the tension by the tension roller 122.

Accordingly, the tension roller 122 is separated from the photosensitive belt 210 as much as the distance in which the protrusion actuating pin 161*a* of the plunger 161 of the solenoid 160 pulls the swing arm 123 in a counterclockwise direction to be moved from the tension position shown in the solid line to the standby position shown in the dotted line of FIG. 6. Accordingly, the tension of the photosensitive belt 210 on which the tension roller 122 acts is released.

As is apparent from the forgoing description, it can be appreciated that the automatic belt tension apparatus of the image forming device according to the present invention can apply the predetermined tension to the transfer belt and the photosensitive belt during performance of the transfer operation and the image forming operation, respectively, so that even if the image forming device is used for a long period of time, or remains unused for a long period of time, the transfer belt and the photosensitive belt can be prevented from being expanded or generating traces at portions thereof coming in contact with the driving and supporting rollers and the like, thereby extending life of the transfer belt and the transfer unit, and the intermediate transfer unit having the same, and the photosensitive belt, and at the same time, maintaining an image quality at a regular level for a long period of time.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An automatic belt tension apparatus for use in an image forming device including at least one belt, and a driving unit supporting the belt and driving the belt to rotate, the automatic belt tension apparatus comprising:

a tension actuating part connected to the driving unit and operated by a driving force of the driving unit;

a tension applying part coupled to the tension actuating part, the tension applying part to selectively apply a predetermined tension to the belt when the driving force is a predetermined range, installed with respect to the belt;

a tension clutch to connect the tension actuating part and the tension applying part, the tension clutch including a clutch spring to generate a sliding friction force, so that the driving force of the tension actuating part is transmitted to the tension applying part only when the driving force is within the predetermined range; and a tension releasing part to operate the tension applying part to not apply the predetermined tension to the belt, installed with respect to the tension applying part.

2. The automatic belt tension apparatus according to claim 1, wherein the tension applying part comprises:

a frame;

a swing shaft having both ends supported at the frame;

a tension roller selectively coming in contact with an inner surface of the belt; and a swing arm fixed on the swing shaft and rotatably supporting the tension roller.

3. The automatic belt tension apparatus according to claim 2, wherein the tension releasing part comprises an elastic member exerting an elastic rotating force on the swing arm, to enable the tension roller to swing in an opposite direction to a direction of contacting with the inner surface of the transfer belt, the elastic member being installed with respect to the frame and the swing arm.

4. The automatic belt tension apparatus according to claim 3, wherein the elastic member comprises a tension spring installed with respect to the swing arm, the tension spring having respective ends supported at the frame and the swing arm.

5. The automatic belt tension apparatus according to claim 3, wherein the tension releasing part comprises a release-enabling member to remove a gear force from the driving unit to swing the swing arm in a direction of separating the tension roller from the inner surface of the belt by the elastic member when the driving unit is stopped from driving.

6. The automatic belt tension apparatus according to claim 5, wherein the release-enabling member comprises a solenoid actuating the swing arm to move in the direction of separating the tension roller from the inner surface of the belt when the driving part is stopped from driving.

7. The automatic belt tension apparatus according to claim 5, wherein the release-enabling member comprises one of a one way power transmitting part, or a swing gear part, disposed on a power transmitting path to transmit a driving force from the driving unit to the tension applying part, and to not transmit a rotating force of the swing arm to the driving unit when the driving unit is stopped from driving and thereby the elastic force of the elastic member acts on the swing arm in the direction of separating the tension roller from the inner surface of the belt.

8. The automatic belt tension apparatus according to claim 5, wherein the release-enabling member comprises a motor power cut part to cut a power of a driving motor driving the driving unit when the driving unit is stopped from driving.

9. The automatic belt tension apparatus according to claim 2, wherein the tension actuating part comprises:

a tension gear installed on the driving unit; and a power transmitting gear train comprising a plurality of power transmitting gears connected with the tension gear, to transmit a driving force of the tension gear to the swing shaft.

10. The automatic belt tension apparatus according to claim 9, wherein the tension clutch is installed on the swing shaft and transmits a driving force transmitted to the power transmitting gear train from the tension gear, to the swing shaft only when the driving force is in a range of a predetermined load torque.

11. The automatic belt tension apparatus according to claim 10, wherein the tension clutch comprises:

a clutch gear, rotatably installed on the swing shaft to engage with the power transmitting gear train, and having a first clutch boss extended in an axial direction;

a bushing having a second clutch boss fixed on the swing shaft; and a clutch spring, coiled on outer circumferential surfaces of the first clutch boss of the clutch gear and the second clutch boss of the bushing, and, when the driving force is transmitted from the power transmitting gear train to the clutch gear, transmitting the driving force to the bushing fixed on the swing shaft only when a driving load of the clutch gear is in the range of the predetermined load torque.

12. The automatic belt tension apparatus according to claim 11, wherein the range of the predetermined load torque of the clutch gear is set such that the tension roller, fixed on the swing shaft through the swing arm, applies the predetermined tension to the belt against a bias of an elastic member of the tension releasing part.

13. An automatic belt tension apparatus for use in an image forming device including a frame, a belt, and a driving unit selectively driving the belt by a driving force, the automatic belt tension apparatus comprising:

a tension applying part to selectively apply a predetermined tension to the belt when the driving force is in a predetermined range, the tension applying part including a swing arm rotatably connected to the frame through a swing shaft, and a tension roller, rotatably positioned on the swing arm to selectively apply a tension to the belt;

an elastic member to elastically bias the swing arm of the tension applying part to separate the tension applying part from the belt; and a tension actuating part to selectively transmit a driving force from the driving unit to the tension applying part, to apply a predetermined tension to the belt, the tension actuating part including a tension gear installed on the driving unit to transmit the driving force and a tension clutch having a clutch spring installed on the swing shaft and transmitting the driving force only when the driving force is in the predetermined range.

14. The automatic belt tension applying apparatus according to claim 13, further comprising a release-enabling member selectively removing a gear force from the driving unit, to swing the swing arm in a direction of separating the tension roller from the inner surface of the belt by the elastic member, when the driving unit is stopped from driving.

15. The automatic belt tension applying apparatus according to claim 14, wherein the release-enabling member comprises a solenoid selectively actuating the swing arm to move in the direction of separating the tension roller from the inner surface of the belt when the driving part is stopped from driving.

16. The automatic belt tension applying apparatus according to claim 14, wherein the release-enabling member comprises one of a one way power transmitting part, or a swing gear part, disposed on a power transmitting path to transmit a driving force from the driving unit to the tension applying part, and to not transmit a rotating force of the swing arm to the driving unit when the driving unit is stopped from driving and an elastic force of the elastic member acts on the swing arm in the direction of separating the tension roller from the inner surface of the belt.

17. The automatic belt tension applying apparatus according to claim 14, wherein the release-enabling member comprises a motor power cut part to cut a power of a driving motor driving the driving unit when the driving unit is stopped from driving.

18. The automatic belt tension applying apparatus according to claim 13, wherein the tension applying part transmits a driving force from the driving unit to the tension applying part only when the driving force is in a predetermined range.

19. The automatic belt tension applying apparatus according to claim 13, wherein the tension actuating part comprises a power transmitting gear train including at least one power transmitting gear, to transmit the driving force from the tension gear to the tension clutch.

20. The automatic belt tension applying apparatus according to claim 13, wherein the tension clutch comprises a clutch gear rotatably installed on the swing shaft and having a first clutch boss to receive the driving force;

a bushing fixed on the swing shaft and having a second clutch boss; and an elastic clutch member transmitting the driving force from the first clutch boss to the second clutch boss only when the driving force is in the predetermined range.

21. The automatic belt tension applying apparatus according to claim 20, wherein:

the elastic clutch member is a clutch spring coiled on outer circumferential surfaces of the first clutch boss and the second clutch boss;

the clutch gear includes a first support; and a first end of the clutch spring is slipably supported by the first support such that the clutch spring only transmits the driving force to the second clutch boss when the driving force is in the predetermined range.

22. The automatic belt tension applying apparatus according to claim 21, wherein:

the bushing includes a second support; and a second end of the clutch spring is fixed or slipably supported by the second support.

23. The automatic belt tension applying apparatus according to claim 21, wherein the first support includes one of a circular-shaped concavo-convex groove or a plurality of spaced-apart grooves circumferentially positioned adjacent to an outer surface of the first clutch boss.

24. The automatic belt tension applying apparatus according to claim 21, wherein the tension clutch includes a clutch ring disposed to enclose the clutch spring.

25. An automatic belt tension apparatus for use in an image forming device including a frame, a belt, and a driving unit, the apparatus comprising:

a swing arm rotatably connected to the frame;

a tension roller connected to the swing arm to selectively contact the belt, an elastic member biasing the swing arm in a first direction;

a tension actuating part transmitting a torque load from the driving unit to the swing arm to overcome the bias of the elastic member and apply a predetermined tension, via the tension roller, to the belt when a torque load is in a predetermined range; and a tension clutch to connect the tension actuating part and the swing arm, the tension clutch including a clutch spring to generate a sliding friction force, so that the driving force of the tension actuating part is transmitted to the swing arm only when the driving force is within the predetermined range.

26. A method for automatically applying a belt tension of an image forming device including at least one belt, and a driving unit supporting and driving the belt to rotate, the method comprising:

driving the driving unit;

selectively transmitting a driving force from the driving unit to a tension applying part when the driving force transmitted from the driving unit is in a predetermined range, the driving force from the driving unit being applied to the tension applying part through a tension clutch, the tension clutch including a clutch spring generating a sliding friction force, so that the driving force is transmitted to the tension applying part only when the driving force is within the predetermined range;

applying a tension to the belt by using the driving force transmitted from the tension applying part;

stopping the driving unit from driving; and releasing the tension applied to the belt.

27. The method as claimed in claim 26, wherein the operation of applying the tension to the belt comprises:

rotating a swing arm in a first direction against a bias of an elastic member by the driving force transmitted from the tension applying part; and bringing the tension roller connected to the swing arm into contact with the belt.

28. The method as claimed in claim 27, wherein the operation of releasing the tension applied to the belt comprises:

removing a gear force from the driving unit;

rotating the swing arm in a second direction, opposite to the first direction by the bias of the elastic member; and separating the tension roller from the belt.

29. The method as claimed in claim 28, wherein the operation of removing the gear force from the driving unit comprises one of:

actuating the swing arm to forcedly rotate in the second direction;

actuating a rotating force to idle the rotating force transmitted from the swing arm to the driving unit by the bias of the elastic member; or cutting a power of a driving motor driving the driving unit.

* * * * *